US009004644B2

(12) United States Patent
Ohhashi

(10) Patent No.: US 9,004,644 B2
(45) Date of Patent: Apr. 14, 2015

(54) LIQUID EJECTION APPARATUS, METHOD OF CONTROLLING LIQUID EJECTION APPARATUS, AND COMPUTER READABLE MEDIUM

(71) Applicant: Masashi Ohhashi, Kasugai (JP)

(72) Inventor: Masashi Ohhashi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/956,017

(22) Filed: Jul. 31, 2013

(65) Prior Publication Data

US 2014/0035989 A1 Feb. 6, 2014

(30) Foreign Application Priority Data

Jul. 31, 2012 (JP) ..... 2012-169706

(51) Int. Cl.

| | |
|---|---|
| ***B41J 2/165*** | (2006.01) |
| ***B41J 29/38*** | (2006.01) |
| ***B41J 13/00*** | (2006.01) |
| ***B41J 11/00*** | (2006.01) |

(52) U.S. Cl.

CPC ..... *B41J 13/0009* (2013.01); *B41J 2/16517* (2013.01); *B41J 11/006* (2013.01); *B41J 2/16585* (2013.01); *B41J 2002/16573* (2013.01)

(58) Field of Classification Search

CPC ..... B41J 2/5056

See application file for complete search history.

(56) References Cited

U.S. PATENT DOCUMENTS

| | | | | |
|---|---|---|---|---|
| 6,290,322 | B1 * | 9/2001 | Noguchi et al. | 347/23 |
| 2010/0309243 | A1 * | 12/2010 | Nakano et al. | 347/15 |
| 2012/0007903 | A1 * | 1/2012 | Igarashi | 347/9 |
| 2012/0127231 | A1 * | 5/2012 | Nukui | 347/19 |

FOREIGN PATENT DOCUMENTS

| | | | |
|---|---|---|---|
| JP | 03267868 | A * | 11/1991 |
| JP | 08281973 | A * | 10/1996 |
| JP | 2002-086754 | A | 3/2002 |
| JP | 2003094672 | A * | 4/2003 |
| JP | 2006-069163 | A | 3/2006 |
| JP | 2008-265241 | A | 11/2008 |
| JP | 2008265241 | A * | 11/2008 |

OTHER PUBLICATIONS

Machine generated English translation to Maru et al., "Inkjet Recorder and Method for Restoring Recording Head"; retrieved from http://www19.ipdl.inpit.go.jp/PA1/cgi-bin/PA1INDEX on Jul. 2, 2014; 18pp.*

* cited by examiner

*Primary Examiner* — Shelby Fidler

(74) *Attorney, Agent, or Firm* — Baker Botts L.L.P.

(57) ABSTRACT

When it is determined that jamming of a recording medium has occurred and an image to be formed on the recording medium is a color image, a liquid ejection apparatus performs recovery action for first nozzle of a first liquid ejection head ejecting black liquid and second nozzles of second liquid ejection heads ejecting color liquid which is not black, after the jamming of the recording medium is resolved. On the other hand, when the image to be formed on the recording medium is a monochrome image, the liquid ejection apparatus performs the recovery action for the first nozzles of the first liquid ejection head.

12 Claims, 11 Drawing Sheets

QUANTIZED IMAGE DATA CORRESPONDING TO BLACK

MASK PATTERN

MONOCHROME DOT IMAGE DATA

COMBINED COLOR IMAGE DATA

LIQUID EJECTION APPARATUS, METHOD OF CONTROLLING LIQUID EJECTION APPARATUS, AND COMPUTER READABLE MEDIUM

CROSS REFERENCE TO RELATED APPLICATION

The present application claims priority from Japanese Patent Application No. 2012-169706, which was filed on Jul. 31, 2012, the disclosure of which is incorporated herein by reference in its entirety.

BACKGROUND OF THE INVENTION

1. Field of the Invention

The present invention relates to a liquid ejection apparatus, a method of controlling the liquid ejection apparatus, and a computer readable medium.

2. Description of Related Art

As a liquid ejection apparatus forming an image on a recording medium, an image formation apparatus having an inkjet printing unit which ejects ink onto sheets has been known. This inkjet printing unit includes a sheet feeding roller pair for feeding sheets and an inkjet record head for ejecting ink through nozzles. When jamming occurs in the inkjet printing unit, a recovery action of the inkjet record head is carried out after resolving the jamming, because particles of the sheet, ink or the like is adhered to the inkjet record head and subsequent image formation may be adversely affected.

SUMMARY OF THE INVENTION

Technical Problem

In the meanwhile, a liquid ejection apparatus capable of forming color images in addition to monochrome images on recording media has been known. This liquid ejection apparatus includes a liquid ejection head ejecting color liquid which is not black, in addition to a liquid ejection head ejecting black liquid. In this regard, when jamming occurs while a monochrome image is being formed on a recording medium, the timing to start the image formation on the recording medium after resolving the jamming may be delayed if the recovery action is conducted for each of all liquid ejection heads.

An aspect of the present invention is to provide a liquid ejection apparatus capable of quickly starting image formation after resolving jamming, and a control method thereof.

Solution to Problem

A liquid ejection apparatus of an embodiment includes: a conveyance mechanism configured to convey a recording medium a first liquid ejection head which includes first nozzles and is configured to eject black liquid through the first nozzles; at least one second liquid ejection head which includes second nozzles and is configured to eject color liquid which is not black through the second nozzles; a sensor configured to detect whether the recording medium conveyed by the conveyance mechanism opposes the first nozzles of the first liquid ejection head of the conveyance mechanism; a maintenance mechanism configured to perform recovery action for the first nozzles of the first liquid ejection head and the second nozzles of the at least one second liquid ejection head, a storage unit configured to store image data of an image formed on the recording medium; and a control device. The control device is configured to: control the first liquid ejection head, the at least one second liquid ejection head, and the conveyance mechanism so that the image of the image data is formed on the recording medium; based on a detection result of the sensor, determine whether jamming of the recording medium has occurred at a position opposing the first nozzles of the first liquid ejection head of the conveyance mechanism; when it is determined that the jamming has occurred while the image of the image data is being formed on the recording medium, control the first liquid ejection head, the at least one second liquid ejection head, and the conveyance mechanism so that the formation of the image of the image data on the recording medium is interrupted until the jamming of the recording medium is resolved; when it is determined based on the image data stored in the storage unit that the image formed on the recording medium is a color image, control the maintenance mechanism so that the recovery action for the first nozzles of the first liquid ejection head and the second nozzles of the at least one second liquid ejection head is performed after the jamming of the recording medium is resolved, and then control the first liquid ejection head, the at least one second liquid ejection head, and the conveyance mechanism so that the formation of the color image on the recording medium based on the image data, which has been interrupted on account of the jamming of the recording medium, is resumed; and when it is determined based on the image data stored in the storage unit that the image formed on the recording medium is the monochrome image, control the maintenance mechanism so that the recovery action for the first nozzles of the first liquid ejection head is performed after the jamming of the recording medium is resolved, and then control the first liquid ejection head and the conveyance mechanism so that the formation of the monochrome image on the recording medium based on the image data, which has been interrupted on account of the jamming of the recording medium, is resumed.

A method of controlling a liquid ejection apparatus of an embodiment for a liquid ejection apparatus including: a conveyance mechanism configured to convey a recording medium; a first liquid ejection head which includes first nozzles and is configured to eject black liquid through the first nozzles; at least one second liquid ejection head which includes second nozzles and is configured to eject color liquid which is not black through the second nozzles; a sensor configured to detect whether the recording medium conveyed by the conveyance mechanism opposes the first nozzles of the first liquid ejection head of the conveyance mechanism; a maintenance mechanism configured to perform recovery action for the first nozzles of the first liquid ejection head and the second nozzles of the at least one second liquid ejection head; a storage unit configured to store image data of an image formed on the recording medium. The method includes: (i) controlling the first liquid ejection head, the at least one second liquid ejection head, and the conveyance mechanism so that the image of the image data is formed on the recording medium; (ii) determining whether the image formed on the recording medium based on the image data stored in the storage unit is a monochrome image or a color image; (iii) based on a detection result of the sensor, determining whether jamming of the recording medium has occurred at a position opposing the first nozzles of the first liquid ejection head of the conveyance mechanism; (iv) when it is determined in the step (iii) that the jamming has occurred while the image of the image data is being formed on the recording medium, controlling the first liquid ejection head, the at least one second liquid ejection head, and the conveyance mechanism so that the formation of the image of the image data on the recording medium is interrupted until the jamming of the recording medium is resolved; when it is determined in the step (ii) based on the image data stored in the storage unit that the image formed on the recording medium is a color image, controlling the maintenance mechanism so that the recovery action for the first nozzles of the first liquid ejection head and the second nozzles of the at least one second liquid ejection head after the jamming of the recording medium is resolved, and then controlling the first liquid ejection head, the at least one second liquid ejection head, and the conveyance mechanism so that the formation of the color image on the recording medium based on the image data, which has been interrupted on account of the jamming of the recording medium, is resumed; and when it is determined in the step (ii) based on the image data stored in the storage unit that the image formed on the recording medium is the monochrome image, controlling the maintenance mechanism so that the recovery action for the first nozzles of the first liquid ejection head is performed after the jamming of the recording medium is resolved, and then controlling the first liquid ejection head and the conveyance mechanism so that the formation of the monochrome image on the recording medium based on the image data, which has been interrupted on account of the jamming of the recording medium, is resumed.

A non-transitory computer readable medium of an embodiment stores a program executed by a liquid ejection apparatus including: a conveyance mechanism configured to convey a recording medium; a first liquid ejection head which includes first nozzles and is configured to eject black liquid through the first nozzles; at least one second liquid ejection head which includes second nozzles and is configured to eject color liquid which is not black through the second nozzles; a sensor configured to detect whether the recording medium conveyed by the conveyance mechanism opposes the first nozzles of the first liquid ejection head of the conveyance mechanism; a maintenance mechanism configured to perform recovery action for the first nozzles of the first liquid ejection head and the second nozzles of the at least one second liquid ejection head; a storage unit configured to store image data of an image formed on the recording medium. The program causes the liquid ejection apparatus to execute: (i) controlling the first liquid ejection head, the at least one second liquid ejection head, and the conveyance mechanism so that the image of the image data is formed on the recording medium; (ii) determining whether the image formed on the recording medium based on the image data stored in the storage unit is a monochrome image or a color image; (iii) based on a detection result of the sensor, determining whether jamming of the recording medium has occurred at a position opposing the first nozzles of the first liquid ejection head of the conveyance mechanism; (iv) when it is determined in the step (iii) that the jamming has occurred while the image of the image data is being formed on the recording medium, controlling the first liquid ejection head, the at least one second liquid ejection head, and the conveyance mechanism so that the formation of the image of the image data on the recording medium is interrupted until the jamming of the recording medium is resolved; when it is determined in the step (ii) based on the image data stored in the storage unit that the image formed on the recording medium is a color image, controlling the maintenance mechanism so that the recovery action for the first nozzles of the first liquid ejection head and the second nozzles of the at least one second liquid ejection head after the jamming of the recording medium is resolved, and then controlling the first liquid ejection head, the at least one second liquid ejection head, and the conveyance mechanism so that the formation of the color image on the recording medium based on the image data, which has been interrupted on account of the jamming of the recording medium, is resumed; and when it is determined in the step (ii) based on the image data stored in the storage unit that the image formed on the recording medium is the monochrome image, controlling the maintenance mechanism so that the recovery action of the first nozzles of the first liquid ejection head is performed after the jamming of the recording medium is resolved, and then controlling the first liquid ejection head and the conveyance mechanism so that the formation of the monochrome image on the recording medium based on the image data, which has been interrupted on account of the jamming of the recording medium, is resumed.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
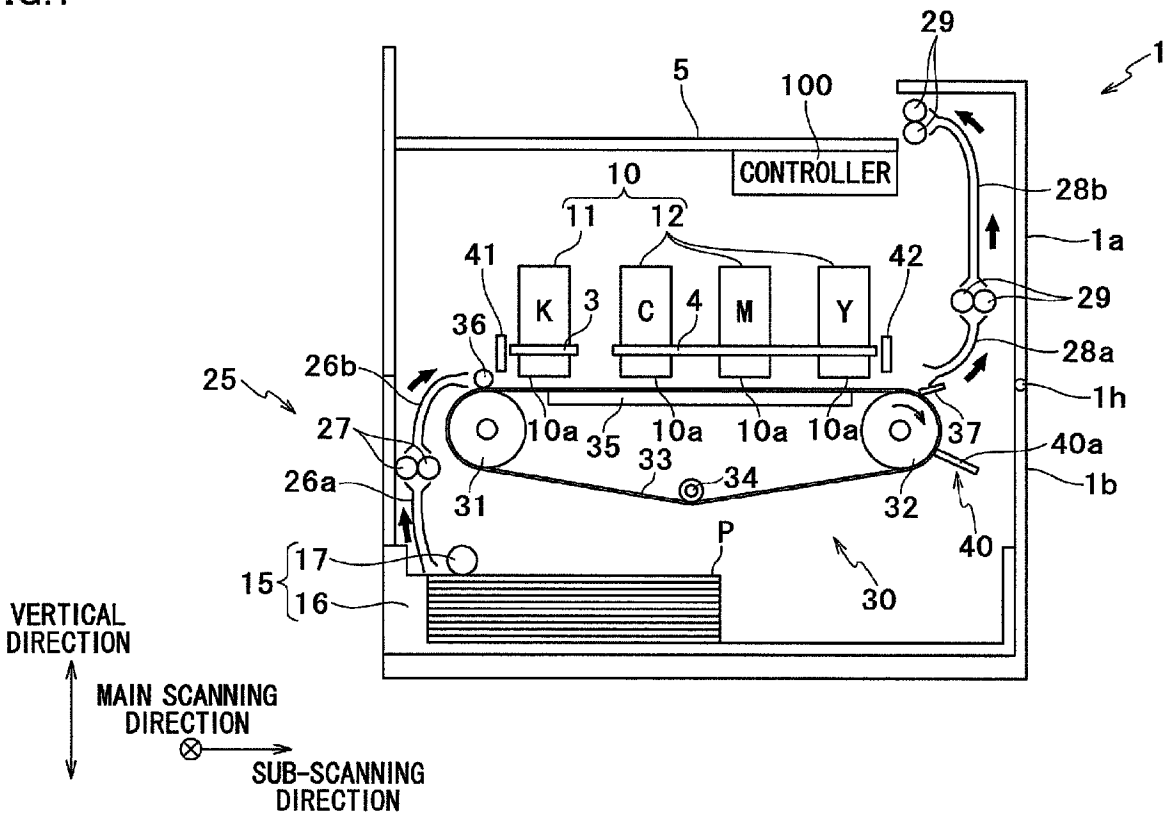
FIG. 1 is a schematic profile showing the overall structure of an inkjet printer of First Embodiment.

With reference to figures, the following will describe a preferred embodiment of the present invention, in which a liquid ejection apparatus is used in an inkjet printer.

(First Embodiment)

To begin with, referring to FIG. 1, the overall structure of the inkjet printer 1 of First Embodiment will be described. The printer 1 includes an upper chassis 1*a* and a lower chassis 1*b* that are both rectangular parallelepiped in shape and are substantially identical with each other in size. The upper chassis 1*a* is an open-bottom box whereas the lower chassis 1*b* is an open-top box. As the upper chassis 1*a* is superposed on the lower chassis 1*b* so that the openings of the respective chassis are sealed by each other, the space inside the printer 1 is defined. Above the top plate of the paper chassis 1*a* is provided a sheet discharge section 5. In the space defined by the upper and lower chassis 1*a* and 1*b*, a conveying path on which sheets P which are recording media are conveyed is formed along the thick arrows in FIG. 1 from a later-described sheet feeding mechanism 15 toward the sheet discharge section 5.

At one lower side, the upper chassis 1*a* is connected to the lower chassis 1*b* via a shaft 1*h* which extends in the main scanning direction. The upper chassis 1*a* is arranged to be rotatable about the shaft 1*h* in a direction including a vertical component, with respect to the lower chassis 1*b*. Being rotatable, the upper chassis 1*a* is switchable between a close position where the upper chassis 1*a* is close to the lower chassis 1*b* and a separated position where the upper chassis 1*a* is far from the lower chassis 1*b* as compared to the upper chassis 1*a* at the close position. When the upper chassis 1*a* is at the separated position, a part of the conveying path is exposed to the outside to secure a working space for user's operations on the conveying path. When the upper chassis 1*a* is at the separated position and the working space is secured, an operation to resolve jamming becomes possible. The operation to resolve jamming is a user's operation to remove the jammed sheet P from the conveying path. In the present embodiment, the upper chassis 1*a* is able to open up to a tilt angle of about 35 degrees with respect to the horizontal plane.

The upper chassis 1*a* houses components such as four inkjet heads 10 (hereinafter, heads 10), sheet sensors 41 and 42, a downstream guide unit of a guide mechanism 25, a wiper unit 55 (see FIGS. 2 and 4), an elevation mechanism 96 (see FIG. 5), a touch panel 50 (see FIG. 5), four cartridges (not illustrated) storing ink supplied to the heads 10, and a controller 100 configured to control each component of the printer 1. Each cartridge is connected to the head 10 via a tube (not illustrated) and a pump (not illustrated). The pump is driven when the ink is forcibly supplied to the head 10 (e.g., in purging or initial supply of liquid). The pump is on standby in other states, and the pump does not obstruct the ink supply to the head 10. As the upper chassis 1*a* rotates upward from the close position to the separated position, all of the housed components are also moved along with the upper chassis 1*a*. It is noted that some of the components housed in the upper chassis 1*a* are not shown in FIG. 1.

The lower chassis 1*b* houses components such as a sheet feeding mechanism 15, a conveyance mechanism 30, a belt cleaning unit 40, and an upstream guide unit of the guide mechanism 25.

The four heads 10 are line-type heads that are long in the main scanning direction and are substantially identical with one another in structure. These heads 10 are arranged to be adjacent to one another along the sub-scanning direction. The lower surface of each head 10 is an ejection surface 10*a* on which nozzles 108 (see FIG. 3) are formed. Among the four heads 10, the most upstream head in the conveyance direction is a black head 11 (first liquid ejection head), and black (K) ink is ejected through the nozzles 108 (first nozzles) of this head 11. The remaining three heads are color heads 12 (second liquid ejection heads). Through the nozzles 108 (second nozzles) of these heads 12, color inks (i.e., cyan (C), magenta (M), and yellow (Y) inks)) are ejected. The head 11 is attached to the upper chassis 1*a* by the head holder 3, whereas the three heads 12 are attached to the upper chassis 1*a* by the head holder 4. It is noted that the sub-scanning direction is a direction in parallel to the direction in which the sheets P are conveyed by the conveyance mechanism 30, and is in parallel to the horizontal direction in FIG. 1. The main scanning direction is a direction in parallel to the horizontal plane and orthogonal to the sub-scanning direction in FIG. 1.

Figure 2:
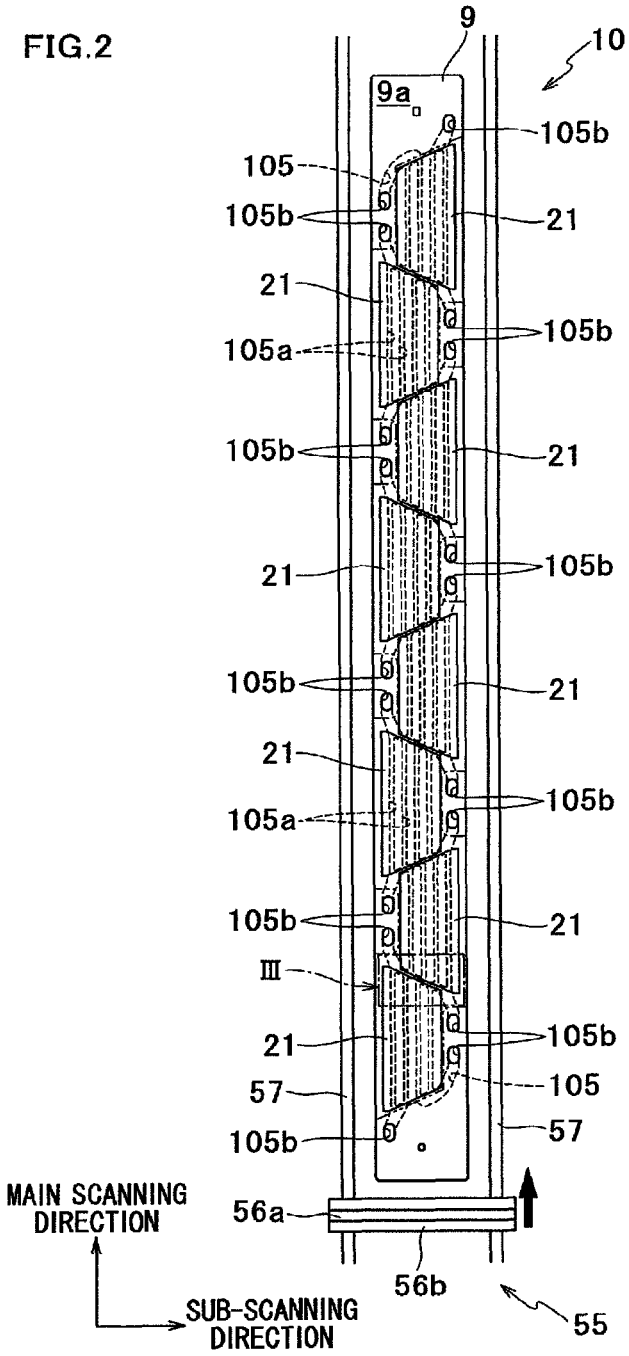
FIG. 2 is a plan view showing a passage unit and a actuator unit of a head of the printer shown in FIG. 1.
Figure 3A:
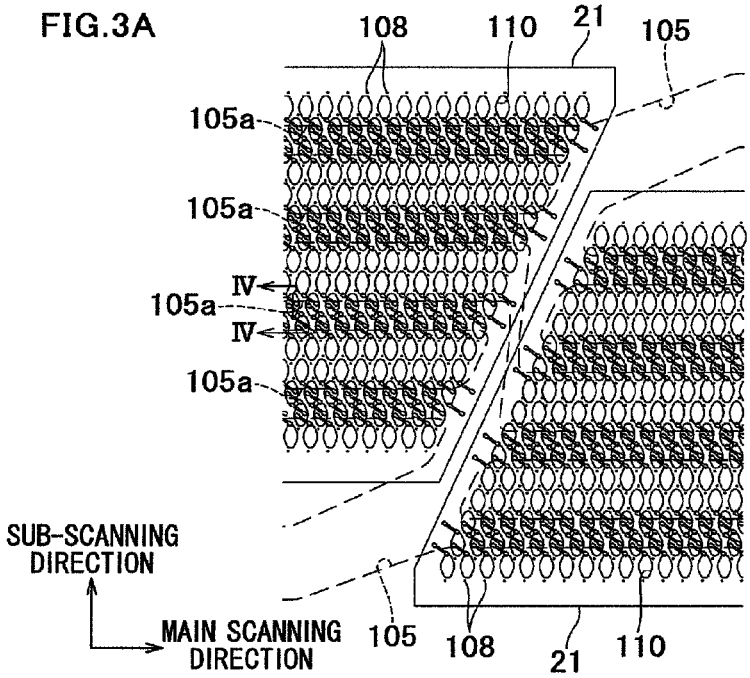
FIG. 3A is an enlarged view of the region III enclosed by the dashed line in FIG. 2.
Figure 3B:
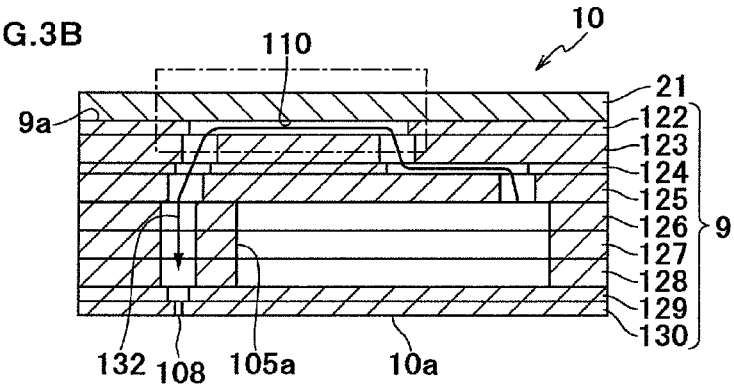
FIG. 3B is a partial cross section taken along the IV-IV line in FIG. 3A.
Figure 3C:
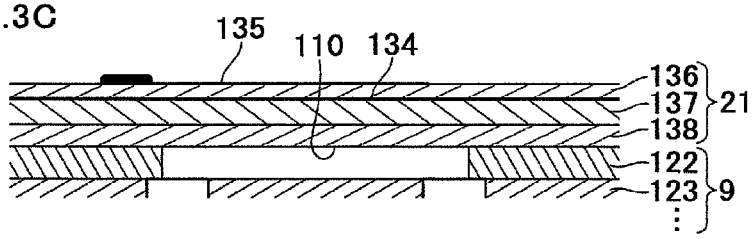
FIG. 3C is an enlarged view of the region enclosed by the dashed line in FIG. 3B.

Now, referring to FIG. 2 to FIG. 3C, the details of the heads 10 will be given. For convenience, pressure chambers 110 and nozzles 108 are depicted by full lines although they are below actuator units 21. Each head 10 is, as shown in FIG. 2, is a laminated body in which eight actuator units 21 are fixed to an upper surface 9*a* of a passage unit 9. On the upper surface 9*a* are formed openings of pressure chambers 110. As shown in FIG. 3B, the actuator units 21 seal these openings and form the side walls of the pressure chambers 110. The passage unit 9 is a laminated body formed by laminating nine stainless plates 122 to 130. Inside the passage unit 9 is formed an ink passage. This ink passage includes a manifold passage 105, which has an ink supply opening 105*b* on the upper surface at one end and from which a sub-manifold passage 105*a* branches, and an individual ink flow passage connecting the outlet of the sub-manifold passage 105*a* with the nozzle 108 on the lower surface via the pressure chamber 110.

Now, the actuator unit 21 will be described. As shown in FIG. 2, each of the eight actuator units 21 is trapezoidal in plan view, and these actuator units 21 are provided along the main scanning direction to circumvent the ink supply openings 105*b*. Each of the actuator units 21 is made of lead zirconate titanate (PZT) ceramics having ferroelectricity, and is constituted by three piezoelectric layers 136 to 138 as shown in FIG. 3C. In the topmost piezoelectric layer 136, a plurality of individual electrodes 135 are formed on the upper surface. The layer 136 is polarized in the thickness direction. The part sandwiched between the individual electrode 135 and the pressure chamber 110 functions as a unimorph actuator. When an electric field is formed between the individual electrode 135 and the common electrode 134 in the polarization directions, the part functioning as the actuator protrudes toward the pressure chamber 110 (on account of unimorph deformation). With this, the ink in the pressure chamber is pressurized and an ink droplet is ejected through the nozzle 108. At this time, the common electrode 134 is maintained at the ground potential. The drive signal is selectively supplied to the individual electrode 135.

The ink ejection in the present embodiment is conducted by a fill-before-fire method. The individual electrode 135 is set at a predetermined electric potential in advance, and the actuator is unimorph-deformed. As the drive signal is supplied, the individual electrode 135 is temporarily changed to the same electric potential as the common electrode 134, and then returns to the predetermined electric potential after a predetermined time elapses. At the same time as the electric potential of the electrode 135 becomes the same electric potential as the common electrode 134, the unimorph deformation of the actuator is canceled and ink is sucked into the pressure chamber 110. When the electric potential returns to the predetermined electric potential, the actuator is unimorph-deformed again and an ink droplet is ejected through the nozzle 108.

The conveyance mechanism 30 includes two belt rollers 31 and 32, a conveyance belt 33, a tension roller 34, a platen 35, a nipping roller 36, and a peeling plate 37. The conveyance belt 33 is an endless belt stretched between the two rollers 31 and 32, and is tensioned by the tension roller 34. The outer circumferential surface of the conveyance belt 33 is a conveyance surface having a silicon layer (weakly-adhesive outer circumferential surface coating layer), and supports the sheets P. The platen 35 is disposed to oppose the four heads 10 to support the upper loop of the conveyance belt 33 from inside. The belt roller 32 is a drive roller and drives the conveyance belt 33. The belt roller 32 is rotated clockwise in FIG. 1 by an unillustrated motor. The belt roller 31 is a driven roller and is driven by the movement of the conveyance belt 33. The nipping roller 36 presses a sheet P having been conveyed from the sheet feeding mechanism 15 onto the conveyance surface of the conveyance belt 33. The peeling plate 37 peels off a conveyed sheet P from the conveyance belt 33 and guides the sheet P to the downstream guide unit of the guide mechanism 25.

The guide mechanism 25 includes the upstream guide unit and the downstream guide unit which are provided to sandwich the conveyance mechanism 30. The upstream guide unit includes two guides 26*a* and 26*b* and a feed roller pair 27. The upstream guide unit connects the sheet feeding mechanism 15 with the conveyance mechanism 30. The downstream guide unit includes two guides 28*a* and 28*b* and two feed roller pairs 29. The downstream guide unit connects the conveyance mechanism 30 with the sheet discharge section 5. The feed roller pairs 27 and 29 are rotated under the control of the controller 100 to convey the sheets P along the conveyance direction.

The sheet feeding mechanism 15 includes a sheet feeding tray 16 and a pickup roller 17. The sheet feeding tray 16 is an open-top box capable of storing the sheets P. The pickup roller 17 is rotated under the control of the controller 100 to sent out the topmost sheet P from the sheet feeding tray 16.

The wiper unit 55 wipes foreign matters (such as ink and paper particles) adhered to the ejection surface 10*a* of the head 10 (i.e., conducts the wiping). In the present embodiment, the wiper unit 55 is arranged to conduct the wiping with respect to the ejection surface 10*a* of only one head 10 at one time. Furthermore, only one wiper unit 55 is provided for the four heads 10. Therefore, when the wiping is conducted for the ejection surfaces 10*a* of a plurality of heads 10, the wiping is conducted for the ejection surfaces 10*a* of the heads 10 one by one. The details of the wiper unit 55 will be given below.

Figure 4A:
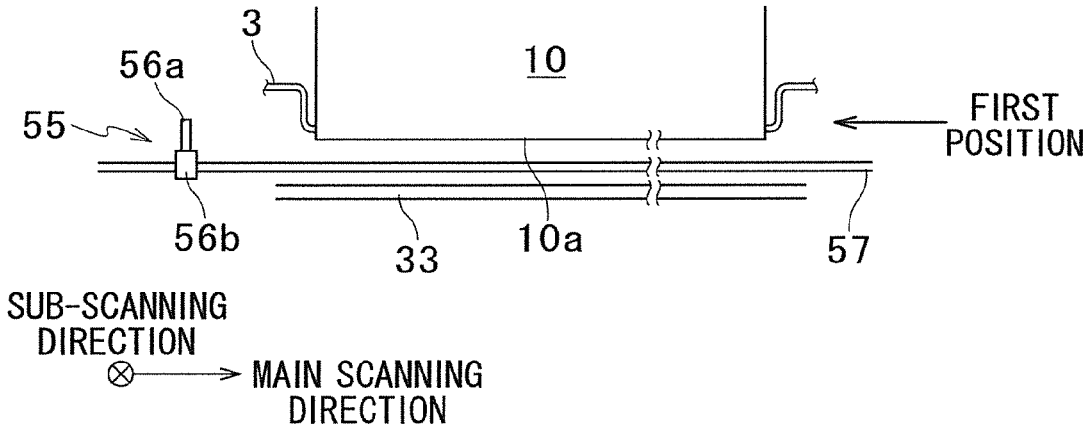
FIG. 4A illustrates the operation of the wiper unit during the image recording.
Figure 4B:
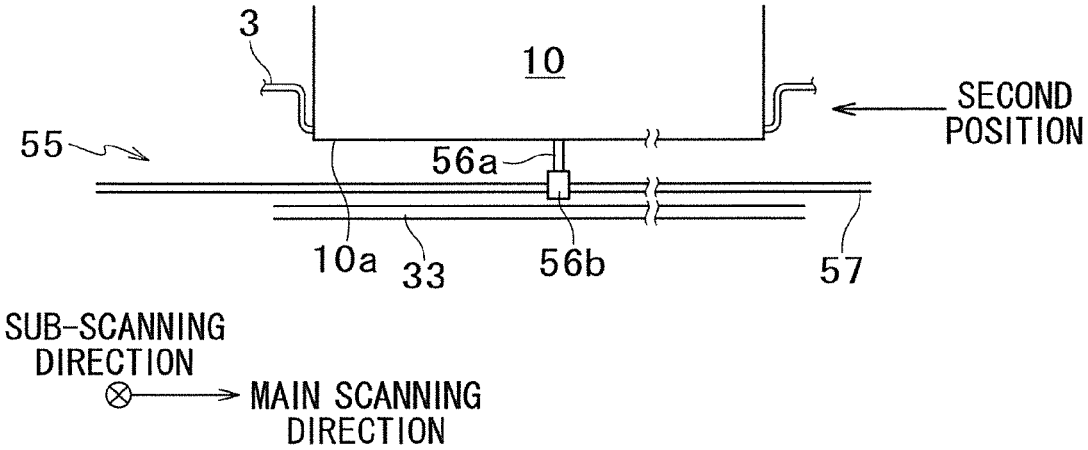
FIG. 4B illustrates the operation of the wiper unit during the wiping.
Figure 5:
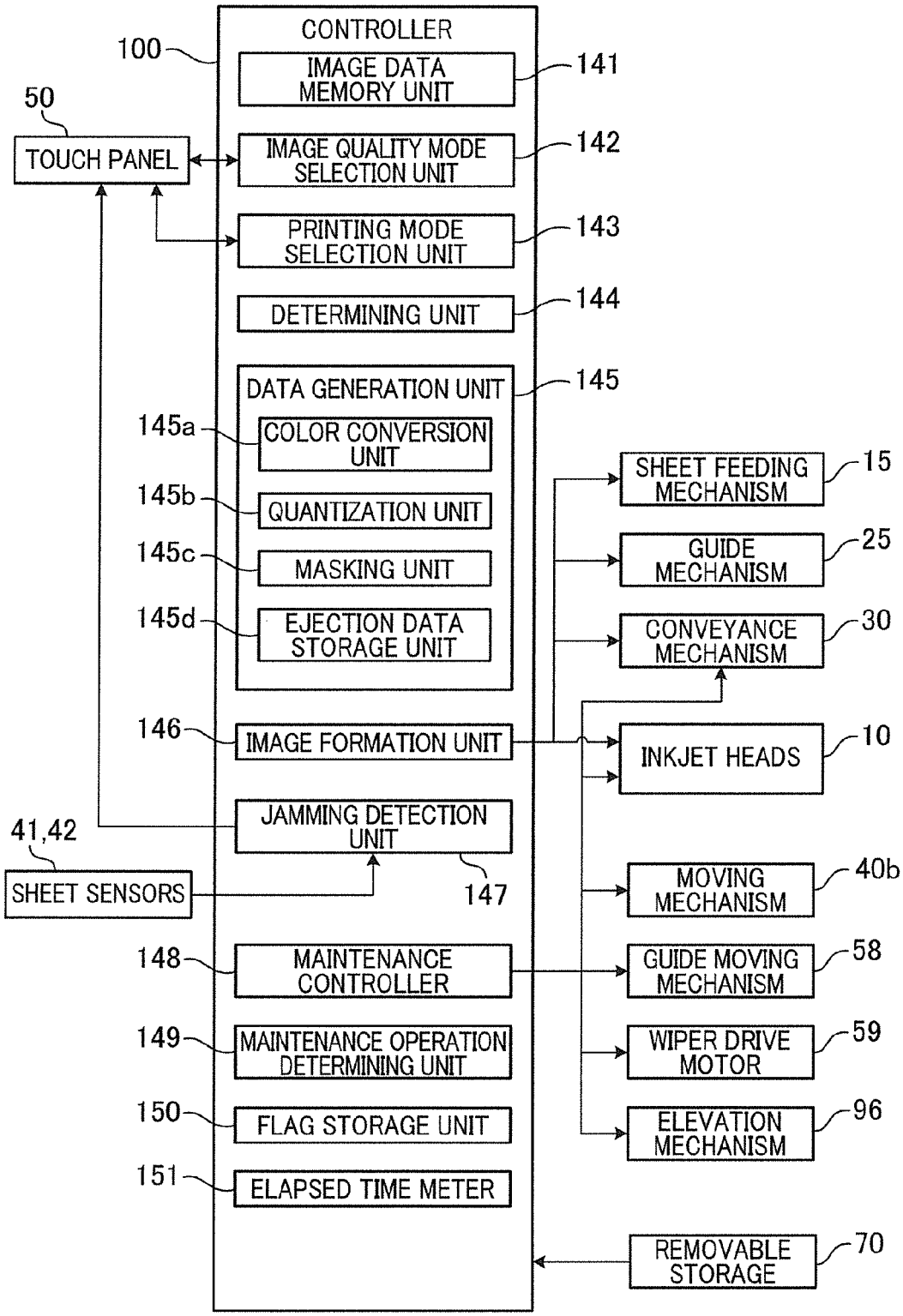
FIG. 5 is a block diagram of the electric configuration of the controller shown in FIG. 1.

As shown in FIG. 2, FIG. 4A, and FIG. 4B, the wiper unit 55 includes a wiper 56*a*, a base portion 56*b* supporting the wiper 56*a*, two guides 57 lined up in the sub-scanning direction, a guide moving mechanism 58 (see FIG. 5), and a wiper drive motor 59 (see FIG. 5). The wiper 56*a* is an elastic plate (made of, for example, rubber), and is slightly longer than the width of the ejection surface 10*a* in the sub-scanning direction. The base portion 56*b* is a rectangular parallelepiped portion and long in the sub-scanning direction. At the longitudinal ends of this portion, cylindrical holes are formed. The holes penetrate the base portion 56*b* in the main scanning direction, and the inner surface of one of these holes is female-threaded. The two guides 57 are round bars extending in the main scanning direction. The outer circumferential surface of one of the guides 57 is male-threaded, and this guide 57 is screwed into the hole of the base portion 56*b* which is female-threaded at the inner surface. The other one of the guides 57 is a round bar having the outer circumferential surface which is not male-threaded, and is inserted into the hole of base portion 56*b* which is not female-threaded.

Under the control of the controller 100, the guide moving mechanism 58 moves the two guides 57 in the sub-scanning direction. As the two guides 57 are moved in the sub-scanning direction, the positions of the wiper 56*a* and the base portion 56*b* are adjusted in the sub-scanning direction. Under the control of the controller 100, the wiper drive motor 59 provides a rotational force to the guide 57 which is female-threaded at the outer circumferential surface. As the wiper drive motor 59 is rotated forward and backward, the base portion 56*b* reciprocates along the guides 57. In this regard, the rotation of the base portion 56*b* is stopped by the other guide 57 which is not male-threaded at the outer circumferential surface.

According to this arrangement, to conduct the later-described wiping, to begin with, a target head 10 is moved to a second position (which will be described below). Thereafter, the center of the ejection surface 10*a* of the target head 10 in the sub-scanning direction is matched with the center of the wiper 56*a* in the sub-scanning direction. Then the base portion 56*b* is moved rightward in FIG. 4A. As a result, while contacting the ejection surface 10*a*, the wiper 56*a* moves from the left edge part of FIG. 4A toward the right edge part of FIG. 4A in the main scanning direction of the ejection surface 10*a*. With this, the foreign matters adhered to the ejection surface 10*a* of the target head 10 are wiped away. Then the base portion 56*b* is returned to the standby position shown in the left part of FIG. 4A.

Under the control of the controller 100, the elevation mechanism 96 performs an elevation operation to move up or down the head holders 3 and 4. Examples of the elevation mechanism 96 includes a rack and a pinion and a solenoid. The elevation mechanism 96 moves up or down the head holders 3 and 4 to selectively change the position of the head 10 between the first position and the second position. As shown in FIG. 4A, the first position is a position where the head 10 is provided in later-described image formation. In this regard, a predetermined gap suitable for image formation is formed between the ejection surface 10*a* and the conveyance surface of the conveyance belt 33. As shown in FIG. 4B, the second position is a position above the first position and a gap between the second position and the conveyance belt 33 is wider than the gap between the first position and the conveyance belt 33. When the head 10 is at the second position, the wiper unit 55 is movable in the space between the head 10 and the conveyance belt 33 (see FIG. 4B).

As shown in FIG. 1, the belt cleaning unit 40 includes a blade 40*a* and a moving mechanism 40*b* (see FIG. 5) and cleans the conveyance surface of the conveyance belt 33. The belt cleaning unit 40 is positioned to the lower right of the conveyance belt 33 so as to oppose the belt roller 32. The blade 40*a* is an elastic plate (made of, for example, rubber) and is able to contact the entire width of the conveyance belt 33 in the main scanning direction. The moving mechanism 40*b* causes the blade 40*a* to contact or to be separated from the conveyance surface of the conveyance belt 33. In later-described cleaning, dirt on the conveyance surface is scraped off by the blade 40*a*.

The sheet sensor 41 is provided on the upstream of the head 11, whereas the sheet sensor 42 is provided on the downstream of the head 12 which is the most downstream head in the conveyance direction. The sheet sensors 41 and 42 are optical reflective sensors detecting a sheet P as the light is reflected on the surface of the sheet P. These sheet sensors 41 and 42 detect the leading edge of a sheet P conveyed by the conveyance mechanism 30 and outputs a detection signal to the controller 100. The sheet sensors 41 and 42 may not be optical reflective sensors but optical transmissive sensors.

Now, referring to FIG. 5, the controller 100 will be detailed. The controller 100 includes a CPU (Central Processing Unit), a ROM (Read Only Memory) rewritably storing programs executed by the CPU and data used in the programs, and a RAM (Random Access Memory) temporarily storing data when a program is being executed. The functional blocks constituting the controller 100 are embodied by the cooperation between the hardware above and software stored in the ROM. As shown in FIG. 5, the controller 100 has an image data memory unit 141, an image quality mode selection unit 142, a printing mode selection unit 143, a determining unit 144, a data generation unit 145, an image formation unit 146, a jamming detection unit 147, a maintenance controller 148, a maintenance operation determining unit 149, a flag storage unit 150, and an elapsed time meter 151.

The programs stored in the ROM of the controller 100 are installed from a removable storage 70 storing the programs. The removable storage 70 is a non-temporary computer-readable medium. Examples of the removable storage 70 include a CD-ROM (Compact Disc Read Only Memory), a flexible disc (FD), and a Magneto Optical (MO). In a variation, the non-temporary computer-readable medium storing the programs may be a fixed recording apparatus such as a hard disc.

The image data memory unit 141 stores image data supplied from an external apparatus (such as a PC connected to the printer 1). The image data is data concerning images formed on sheets P.

As the image quality mode of an image formed on a sheet P, the image quality mode selection unit 142 selects one of a normal image quality mode and a high image quality mode with which the image quality is higher than that of the normal image quality mode. More specifically, the image quality mode selection unit 142 controls the touch panel 50 to display an image quality mode selection screen. Thereafter, the image quality mode selected by the user through the touch panel 50 is set as the image quality mode of the image formed on the sheet P. Alternatively, an instruction regarding an image mode related to image data is supplied from an external apparatus together with the image data, and the image quality mode selection unit 142 executes the instruction regarding the image mode so as to select the image mode of the image to be formed on the sheet P.

As a printing mode of the image formed on the sheet P, the printing mode selection unit 143 selects one of a monochrome printing mode with which a monochrome image is formed on the sheet P and a color printing mode with which a color image is formed on the sheet P. More specifically, the printing mode selection unit 143 controls the touch panel 50 so that a printing mode selection screen is displayed. Subsequently, the printing mode selected by the user through the touch panel 50 is selected as the printing mode of an image formed on the sheet P. Alternatively, an instruction regarding a printing mode related to image data is supplied from an external apparatus together with the image data, and the printing mode selection unit 143 executes the instruction regarding the printing mode so as to select the printing mode of the image formed on the sheet P.

The determining unit 144 determines whether the image to be formed on the sheet P is a monochrome image or a color image based on the image data stored in a image data storage unit 141, before the image formation unit 146 starts later-described image formation. Note that, even if the image data stored in the image data storage unit 141 is color image data, the determining unit 144 determines that the image to be formed on the sheet P is a monochrome image, when the printing mode selection unit 143 has selected the monochrome printing mode.

The data generation unit 145 generates ejection data of each head 10 based on the image data stored in the image data memory unit 141, and includes a color conversion unit 145*a*, a quantization unit 145*b*, a masking unit 145*c*, and an ejection data storage unit 145*d*.

The color conversion unit 145*a* conducts color conversion (density conversion) of the image data stored in the image data memory unit 141, based on the result of the determination by the determining unit 144. In the present embodiment, when the determining unit 144 has determined that the image to be formed on the sheet P is a monochrome image, the color conversion unit 145*a* generates a single set of color conversion image data corresponding to black, from the image data stored in the image data memory unit 141. On the other hand, when the determining unit 144 has determined that the image to be formed on the sheet P is a color image, the color conversion unit 145*a* generates four sets of color conversion image data corresponding to black, cyan, magenta, and yellow, respectively, from the image data stored in the image data memory unit 141. It is noted that the processing by the color conversion unit 145*a* is conducted in accordance with a color conversion table. Each set of color conversion image data generated by the color conversion unit 145*a* includes a color density value (gradation value) of each of matrix-arranged pixels corresponding to a region of the sheet P where the image is to be formed.

Figure 6A:
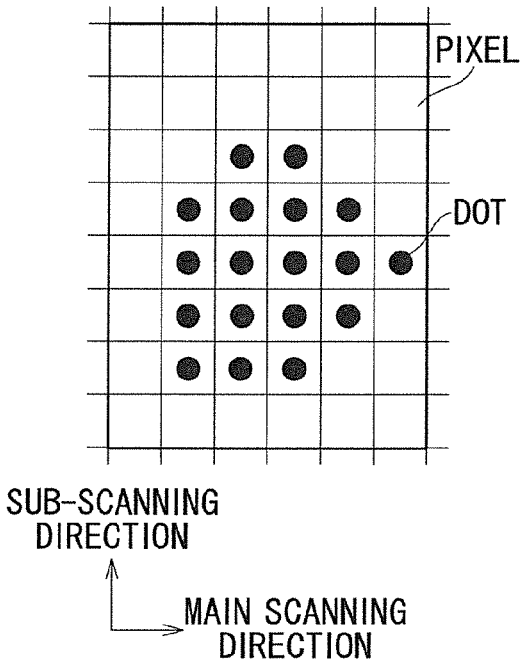
FIG. 6A shows synthesized ejection data.

The quantization unit 145*b* generates low-gradation quantized image data for ejection, from high-gradation (e.g., 256-level) color conversion image data generated by the color conversion unit 145*a*. For example, when the printer 1 is capable of two-level image formation of "zero or with droplet", binary quantization (halftone process) is conducted. When the printer 1 is capable of four-level image formation of "zero, small droplet, middle-sized droplet, or large droplet", quaternary quantization is conducted. The following deals with an example in which binary image formation is conducted. An example of quantized image data corresponding to black processed by the quantization unit 145*b* is shown in FIG. 6A. The quantized image data shown in FIG. 6A indicates the presence or absence of ejection in each of matrix-arranged pixels corresponding to the region on the sheet P where the image is to be formed. The size of each pixel is, in the main-scanning direction, arranged to be identical with the interval of the nozzles 108 in the main scanning direction of the head 10 or an integral multiple of the interval, and is, in the sub-scanning direction, determined by multiplying the printing cycle of the head 10 by the conveyance speed of the sheet P.

In the present embodiment, when the image quality mode selection unit 142 selects the high image quality mode as the printing mode, black pixels of the image formed on the sheet P are constituted by single-color dots formed only by black ink and composite black combined color dots formed by yellow, cyan, and magenta inks. As such, because black pixels of the image are formed on the sheet P by using combined color dots, the image quality is improved as compared to a case where an image is formed only by single-color dots. Furthermore, in the present embodiment, even if the image quality mode selection unit 142 has selected the normal image quality mode as the printing mode, when the image to be formed on the sheet P is a monochrome image, the black pixels of the monochrome pixels are formed by using the single-color dots and the combined color dots, in the image formation until the jamming detection unit 147 detects jamming. With this, even if the image to be formed on the sheet P is a monochrome image, ink is ejected through the nozzles 108 of the head 12, and hence the drying of the ink in the nozzles 108 of the head 12 is restrained.

Figure 6B:
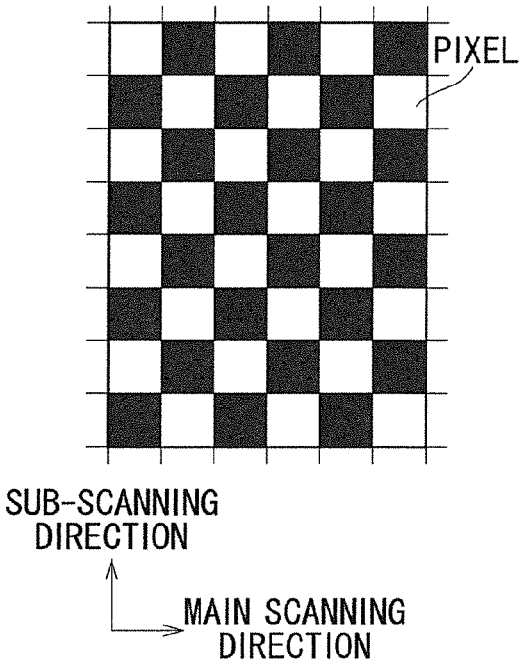
FIG. 6B shows a mask pattern.
Figure 6C:
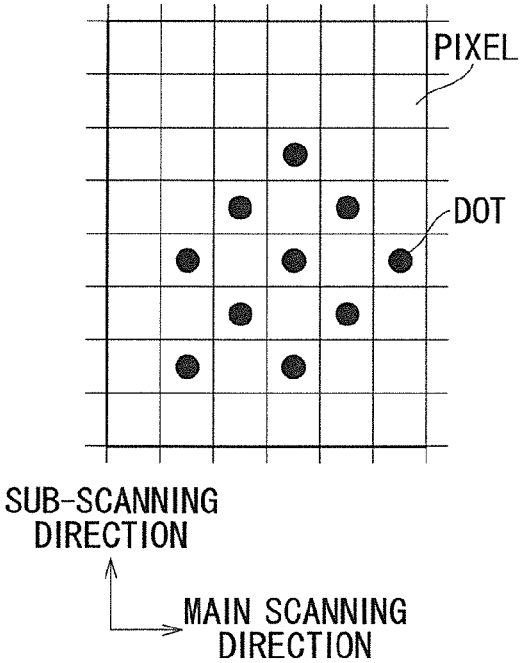
FIG. 6C shows monochrome dot image data.
Figure 6D:
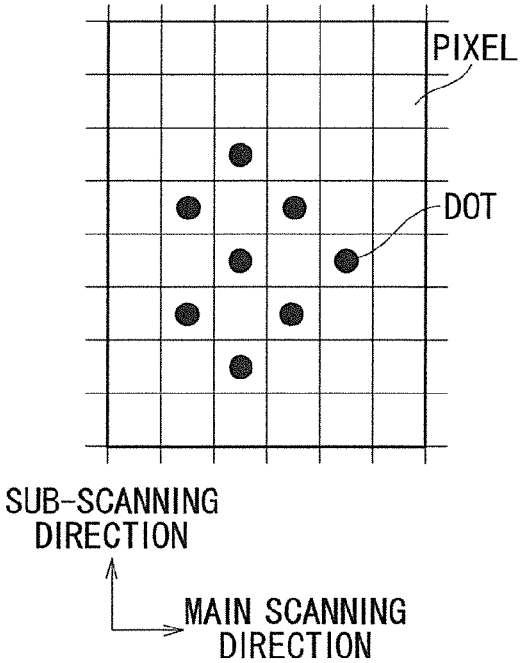
FIG. 6D shows combined color dot image data.

The masking unit 145*c* generates monochrome dot image data and combined color dot image data from quantized image data corresponding to the black processed by the quantization unit 145*b* (hereinafter, the date may be referred to as synthesized ejection data), in such a way that the black pixels of the image to be formed on the sheet P are formed by using both the single-color dots and the combined color dots. More specifically, the masking unit 145*c* processes the quantized image data corresponding to the black (see FIG. 6A) such that thinned data thinned by a mask pattern (see FIG. 6B) is set as monochrome dot image data (see FIG. 6C) and difference data indicating a difference between the quantized image data and the thinned data is set as combined color dot image data (see FIG. 6D). The mask pattern of the present embodiment is, as shown in FIG. 6B, a checkered mask pattern. As a result, in the image to be formed on the sheet P, neighboring black pixels are formed such that, when one black pixel is formed by the single-color dot, the other black pixel is formed by the combined color dot. As a result, because the number of nozzles 108 not ejecting ink in the image formation is reduced, it is possible to restrain the drying of the ink in the nozzles 108. As a variation, the thinned data may be combined color dot image data whereas difference data may be monochrome dot image data.

The ejection data storage unit 145*d* stores ejection data of each head 10. More specifically, when the determining unit 144 has determined that the image to be formed on the sheet P is a monochrome image, the ejection data storage unit 145*d* stores the monochrome dot image data generated by the masking unit 145*c* as black ejection data for ejecting ink from the head 11 and stores the combined color dot image data generated by the masking unit 145*c* as color ejection data for ejecting ink from the head 12.

In addition to the above, when the determining unit 144 has determined that the image to be formed on the sheet P is a color image and the image quality mode selection unit 142 has selected the normal image quality mode as the printing mode, the ejection data storage unit 145*d* stores the quantized image data corresponding to cyan, magenta, and yellow, which has been processed by the quantization unit 145*b*, as color ejection data for ejecting ink from each head 12. Furthermore, the ejection data storage unit 145*d* stores the quantized image data corresponding to the black as black ejection data for ejecting ink from the head 11.

In the meanwhile, when the determining unit 144 has determined that the image to be formed on the sheet P is a color image and the image quality mode selection unit 142 has selected the high image quality mode as the printing mode, the ejection data storage unit 145*d* stores, as color ejection data for ejecting ink from each head 12, data generated by synthesizing the quantized image data corresponding to cyan, magenta, and yellow having been processed by the quantization unit 145*b* with the combined color dot image data generated by the masking unit 145*c*. Furthermore, the ejection data storage unit 145*d* stores the monochrome dot image data generated by the masking unit 145*c* as black ejection data for ejecting ink from the head 11.

The image formation unit 146 conducts image formation based on a printing instruction input from an external apparatus. More specifically, the image formation unit 146 controls the sheet feeding mechanism 15, the guide mechanism 25, and the conveyance mechanism 30 such that the sheets P are conveyed at a predetermined conveyance speed along the conveyance direction. In this regard, when the image quality mode selection unit 142 has selected the high image quality mode as the image quality mode, the conveyance speed of the sheets P is slowed down as compared to the case where the normal image quality mode is selected. Because positional deviations of the dots formed on each sheet P are restrained by this, the image quality is improved.

In addition to the above, the image formation unit 146 controls the ink ejection from the head 11 so that black ink is ejected to the sheet P, based on the black ejection data stored in the ejection data storage unit 145*d*. Furthermore, the image formation unit 146 controls the ink ejection from each head 12 so that cyan, magenta, and yellow inks are ejected onto the sheet P, based on the color ejection data stored in the ejection data storage unit 145*d*. The ink ejection timing is determined based on the detection of the leading end of the sheet P by the sheet sensor 41. That is to say, the ink ejection timing comes when a predetermined time elapses after the detection of the sheet P. This predetermined time is calculated for each head 10 by dividing, by the conveyance speed of the sheet P, the distance from the leading end of the sheet P when the sheet sensor 41 detects that leading end to the most upstream nozzle 108 along the conveying path.

The jamming detection unit 147 detects (determines) that jamming occurs in the conveyance mechanism 30 (i.e., between the ejection surface 10*a* and the conveyance belt 33) when, while the image formation unit 146 is conducting image formation (i.e., an image is being formed on the sheet P based on the image data), the interval between the detections of the leading end of the sheet P by the two sheet sensors 41 and 42 exceeds a predetermined time. This predetermined time is calculated by dividing the conveyance distance between the two sheet sensors 41 and 42 by the conveyance speed of the sheet P. When the jamming detection unit 147 detects jamming, the image formation unit 146 stops the ejection of ink and the conveyance of the sheet P. Furthermore, upon detection of the jamming, the jamming detection unit 147 causes the touch panel 50 to display a screen which notifies the user of the occurrence of the jamming.

When the above-described jamming occurs, the user removes the jammed sheet P. After removing the jammed sheet P, the user inputs a printing restart instruction to the touch panel 50. Furthermore, when the above-described jamming occurs and the sheet P contacts the ejection surface 10*a*, paper particles of the sheet P, ink ejected from a neighboring head 10 or the like may adhere to the ejection surface 10*a* of each head 10. Furthermore, the meniscus of each nozzle 108 of the head 10 may be broken. If the image formation is continued in this state, adverse effects such as the deterioration in the image quality on the sheet P may be caused. In consideration of this, in the present embodiment, a maintenance operation is conducted when the user inputs the printing restart instruction.

In the maintenance operation, the maintenance controller 148 controls the head 10, the conveyance mechanism 30, the moving mechanism 40*b*, the guide moving mechanism 58, the wiper drive motor 59, and the elevation mechanism 96. The maintenance operation including a recovery action for the nozzles 108 of the heads 10 includes flushing and wiping and further includes cleaning for the preparation of image formation. There are three types of maintenance operations, namely a first maintenance operation, a second maintenance operation, and a third maintenance operation. In the first maintenance operation, the flushing and the wiping are conducted only for the head 11. In the second maintenance operation, the flushing and the wiping are conducted for not only the head 11 but also the three heads 12. In the third maintenance operation, the flushing and the wiping are conducted only for the three heads 12.

The flushing is an action to forcibly eject ink through the nozzles 108 by driving the actuator of the heads 10. The wiping is performed after the flushing, and is an operation to wipe away the foreign matters adhered to the ejection surface 10*a* of the target head 10 by controlling the guide moving mechanism 58 and the wiper drive motor 59. The cleaning is performed after the flushing, and is an operation to remove ink or the like ejected onto the conveyance surface of the conveyance belt 33 by controlling the conveyance mechanism 30 and the moving mechanism 40*b*. In the present embodiment, the actuator of the heads 10 and the wiper unit 55 are equivalent to the maintenance mechanism.

The maintenance operation determining unit 149 determines, as a maintenance operation performed immediately after the jamming removal, which one of the first maintenance operation and the second maintenance operation is to be performed. In this connection, as described above, because the wiping is performed only once for the ejection surface 10*a* of a single head 10, the processing time required for the second maintenance operation is longer than the processing time required for the first maintenance operation. Therefore, when it is unnecessary to eject ink through the nozzles 108 of the heads 12 in the image formation after resolving the jamming, the maintenance operation determining unit 149 determines that the first maintenance operation is to be executed. This makes it possible to start the image formation early after resolving the jamming. More specifically, when the determining unit 144 has determined that the image to be formed on the sheet P is a monochrome image and the image quality mode selection unit 142 has selected the normal image quality mode as the printing mode, the maintenance operation determining unit 149 determines to execute the first maintenance operation. In other cases, the maintenance operation determining unit 149 determines to execute the second maintenance operation.

The flag storage unit 150 stores a flag. This flag indicates the necessity of the execution of the third maintenance operation when it is in the on state. The flag indicates that the execution is unnecessary when it is in the off state. The flag is initially in the off state. The elapsed time meter 151 measures time having elapsed from the detection of jamming by the jamming detection unit 147.

Figure 7:
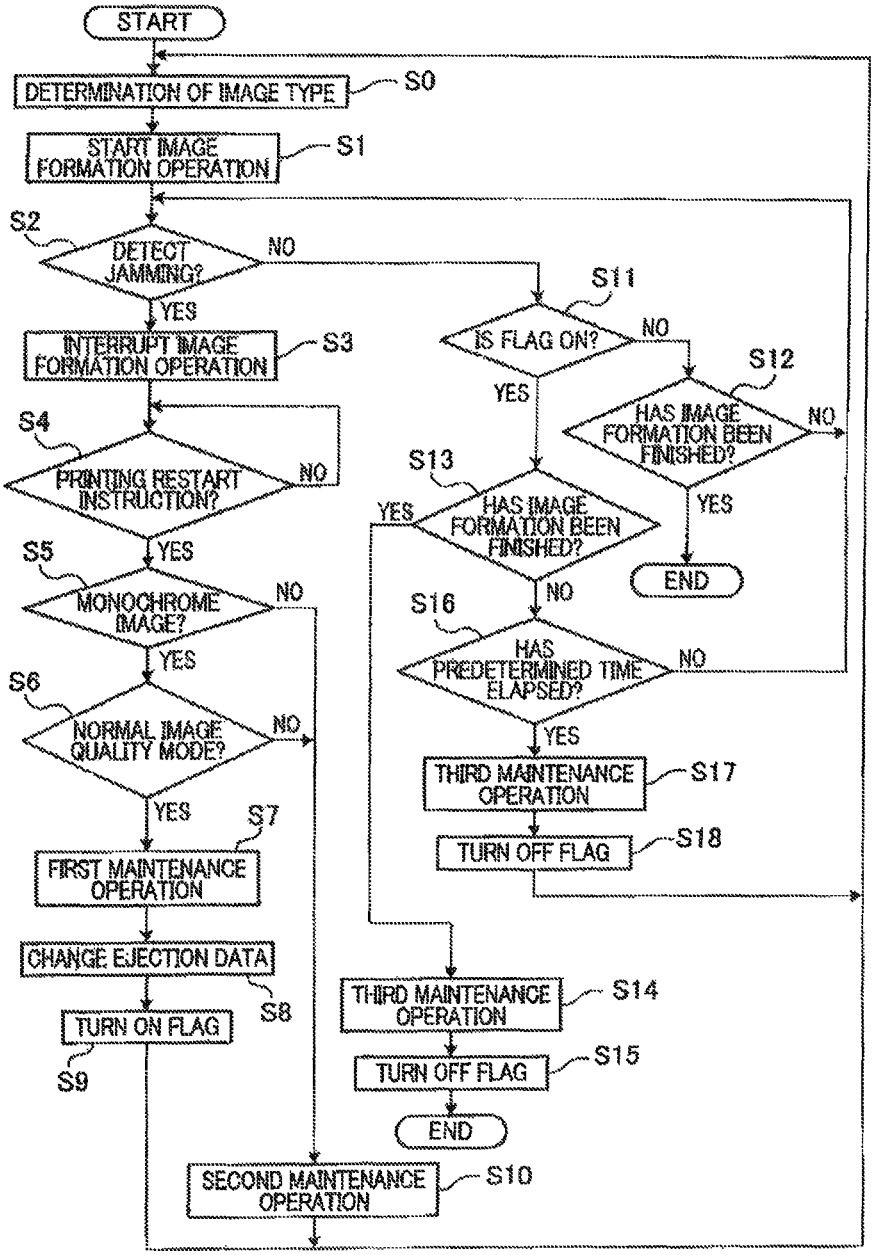
FIG. 7 shows an operation flow of the controller shown in FIG. 1.

Now, the operation of the printer 1 will be described. As shown in FIG. 7, when the controller 100 receives a printing instruction from an external apparatus, the image formation unit 146 controls the sheet feeding mechanism 15, the guide mechanism 25, the conveyance mechanism 30, and the heads 10 to start the image formation indicated by the received printing instruction. When the image formation starts, the jamming detection unit 147 determines whether a conveyed sheet P is jammed in the conveyance mechanism 30 (at a position opposing the ejection surface 10*a* of each head 10) is detected (S2).

When the jamming detection unit 147 detects the occurrence of jamming (S2: YES), the image formation unit 146 controls the sheet feeding mechanism 15, the guide mechanism 25, the conveyance mechanism 30, and the heads 10 so that the image formation is interrupted until the jamming of the sheet P is resolved (S3). Furthermore, the jamming detection unit 147 causes the touch panel 50 to display a screen to notify the user of the occurrence of the jamming. At the same time, the elapsed time meter 151 starts the measurement of the time having elapsed from the occurrence of the jamming. Thereafter, the controller 100 waits for a printing restart instruction from the user, after the jammed sheet P is removed (S4). Receiving a printing restart instruction (S4: YES), the maintenance operation determining unit 149 determines whether the image to be formed on the sheet P, which has been determined by the determining unit 144, is a monochrome image (S5). When the image is not a monochrome image (S5: NO) the maintenance operation determining unit 149 determines that the second maintenance operation is to be executed, and the process proceeds to the step S10.

On the other hand, when the image is a monochrome image (S5: YES), the maintenance operation determining unit 149 determines whether the image quality mode selected by the image quality mode selection unit 142 is the normal image quality mode (S6). When the mode is not the normal image quality mode (S6: NO), the maintenance operation determining unit 149 determines that the second maintenance operation is to be executed, and the process proceeds to the step S10. As such, when the high image quality mode is selected as the image quality mode, a high-quality image is formed because the black pixels of the image formed on the sheet P are formed by using the single-color dots and the combined color dots even in the image formation after resolving the jamming.

On the other hand, if it is determined in the step S6 that the mode is the normal image quality mode (S6: YES), the maintenance operation determining unit 149 determines that the first maintenance operation is to be executed. Thereafter, to execute the first maintenance operation, the maintenance controller 148 controls the head 11, the conveyance mechanism 30, the moving mechanism 40*b*, the guide moving mechanism 58, the wiper drive motor 59, and the elevation mechanism 96 (S7). More specifically, the maintenance controller 148 controls only the head 11 so that the ink is ejected from the nozzles 108 of the head 11 onto the conveyance belt 33 (flushing). Subsequently, the maintenance controller 148 controls the elevation mechanism 96 so that only the head holder 3 is moved up, with the result that the head 11 is moved to the second position (see FIG. 4(*b*)). Then the maintenance controller 148 controls the guide moving mechanism 58 so as to match the center of the ejection surface 10*a* of the head 11 in the sub-scanning direction with the center of the wiper 56*a* in the sub-scanning direction. The maintenance controller 148 then controls the wiper drive motor 59 so as to move the wiper 56*a* relative to the ejection surface 10*a* of the head 11 (wiping). With this, the foreign matters adhered to the ejection surface 10*a* of the head 11 are wiped away. Thereafter, the maintenance controller 148 controls the elevation mechanism 96 to move the head 11 to the first position (see FIG. 4(*a*)). The maintenance controller 148 then controls the moving mechanism 40*b* to cause the blade 40*a* to contact the conveyance surface of the conveyance belt 33 and controls the conveyance mechanism 30 to move the conveyance belt 33 (cleaning). As a result, the ink ejected on the conveyance surface of the conveyance belt 33 is scraped off by the blade 40*a*. As such, all steps of the first maintenance operation are completed.

Furthermore, while the step S7 is being executed, the data generation unit 145 starts the generation of new black ejection data based on the image data stored in the image data memory unit 141 so that the black pixels of the monochrome image are formed solely by the single-color dots. After the completion of the first maintenance operation in the step S7, the data generation unit 145 stores the newly-generated black ejection data in the ejection data storage unit 145*d* (S8). With this, in the subsequent image formation, the black pixels of a monochrome image formed on a sheet P are formed exclusively by single-color dots constituted solely by black ink. After the step S8, the maintenance controller 148 changes the flag stored in the flag storage unit 150 to the on state (S9). Then the process goes back to the step S1 and image formation on a new sheet P starts.

In the step S10, the maintenance controller 148 controls the heads 11 and 12, the conveyance mechanism 30, the moving mechanism 40*b*, the guide moving mechanism 58, the wiper drive motor 59, and the elevation mechanism 96 to execute the second maintenance operation. More specifically, the maintenance controller 148 controls all heads 10 to eject ink from the nozzles 108 of each head 10 to the conveyance belt 33 (flushing). Subsequently, the maintenance controller 148 controls the elevation mechanism 96 to move up the head holders 3 and 4 so as to move the four heads to the second position. The maintenance controller 148 then controls the guide moving mechanism 58 so as to match the center of the ejection surface 10*a* of the head 11 in the sub-scanning direction with the center of the wiper 56*a* in the sub-scanning direction, and then controls the wiper drive motor 59 to move the wiper 56*a* relative to the ejection surface 10*a* of the head 11 (wiping). Thereafter, among the three heads 12, after the center in the sub-scanning direction of the ejection surface 10*a* of the uppermost head 12 in the conveyance direction is matched with the center of the wiper 56*a* in the sub-scanning direction, the wiper drive motor 59 is controlled so that the wiper 56*a* is moved related to the ejection surface 10*a* of the head 12 (wiping). Then the wiping is performed in a similar manner for the remaining two heads 12. The maintenance controller 148 controls the elevation mechanism 96 to move the four heads 10 to the first position, and then performs the cleaning in a similar manner as in the above-described first maintenance operation. As such, all steps of the second maintenance operation are finished. After the step S10, the process goes back to the step S1 and image formation onto a new sheet P starts.

If it is determined in the step S2 that the jamming detection unit 147 does not detect jamming (S2: NO), the maintenance operation determining unit 149 determines whether the flag stored in the flag storage unit 150 is in the on state (S11). When the flag is not in the on state (S11: NO), the process proceeds to the step S12 because it is unnecessary to perform the recovery action (third maintenance operation) for the nozzles 108 of the three heads 12. In the step S12, the maintenance operation determining unit 149 determines whether the image formation by the image formation unit 146 based on a printing instruction (printing restart instruction) has been finished. When the image formation has not been finished (S12: NO), the process goes back to the step S2 to continue the image formation. On the other hand, when the image formation has been finished (S12: YES), the process is terminated.

When it is determined in the step S11 that the flag is in the on state (S11: YES), the maintenance operation determining unit 149 determines whether the image formation by the image formation unit 146 based on the printing instruction (printing restart instruction) has been finished (S13). When the image formation has been finished (S13: YES), the process goes back to the step S14 on account of the necessity to conduct the third maintenance operation.

In the step S14, the maintenance controller 148 controls the heads 12, the conveyance mechanism 30, the moving mechanism 40*b*, the guide moving mechanism 58, the wiper drive motor 59, and the elevation mechanism 96 to execute the third maintenance operation. More specifically, the maintenance controller 148 controls only three heads 12 to eject ink from the nozzles 108 of each head 12 to the conveyance belt 33 (flushing). Subsequently, the maintenance controller 148 controls the elevation mechanism 96 to move up only the head holder 4 so as to move the three heads 12 to the second position. The maintenance controller 148 then controls the guide moving mechanism 58 to match the ejection surface 10*a* of one of the three heads 12 in the sub-scanning direction with the center of the wiper 56*a* in the sub-scanning direction, and then controls the wiper drive motor 59 to move the wiper 56*a* relative to the ejection surface 10*a* of the head 12 (wiping). Then the wiping is serially performed for the remaining two heads 12. Thereafter, the maintenance controller 148 controls the elevation mechanism 96 to move the heads 12 to the first position, and then performs the cleaning in a similar manner as in the first maintenance operation above. As such, all steps of the third maintenance operation are finished. With the arrangement above, even if the ink is ejected from the nozzles 108 of the heads 12 in the subsequent image formation, the quality of the image formed on the sheet P is not deteriorated. After the step S14, the maintenance controller 148 turns off the flag stored in the flag storage unit 150 (S15) and the process is terminated. On the other hand, if it is determined in the step S13 that the image formation has not been finished (S13: NO), the maintenance operation determining unit 149 determines whether the elapsed time measured by the elapsed time meter 151 is at least equal to a predetermined time (S16). When the elapsed time is shorter than the predetermined time (S16: NO), the process goes back to the step S2 to continue the image formation. On the other hand, when the elapsed time is not shorter than the predetermined time (S16: YES), the image formation unit 146 controls the sheet feeding mechanism 15, the guide mechanism 25, the conveyance mechanism 30, and the head 10 so that the image formation is interrupted until the third maintenance operation is finished, in consideration of the necessity of the third maintenance operation, and the process goes back to the step S17. In the step S17, the maintenance controller 148 executes the third maintenance operation in a similar manner as in the step S14 above. When the recovery action of the nozzles 108 of the heads 12 is not carried out for a long time after the occurrence of jamming, it becomes difficult to recover the nozzles 108 when conducting the recovery action (e.g., an amount of ink ejected from the nozzles 108 must be increased). As a result, it may be impossible to fully recover the nozzles 108. In this regard, in the present embodiment, because the third maintenance operation is always conducted when at least the predetermined time elapses from the occurrence of the jamming while the recovery action is not performed for the nozzles 108 of the heads 12, the recovery of the nozzles 108 of the heads 12 is easily and certainly achieved. After this step S17, the maintenance controller 148 turns off the flag stored in the flag storage unit 150 (S18) and the process goes back to the step S1 to restart the image formation. The printer 1 operates in this way.

As described above, in the printer 1 of the present embodiment, when an image formed on a sheet P is a monochrome image and the normal image quality mode is selected as the image quality mode, the image formation is re-started after the jamming of the sheet P is resolved, without conducting the recovery action of the nozzles 108 of the three heads 12. This makes it possible to restart the image formation early after resolving the jamming.

(Second Embodiment)

Figure 8:
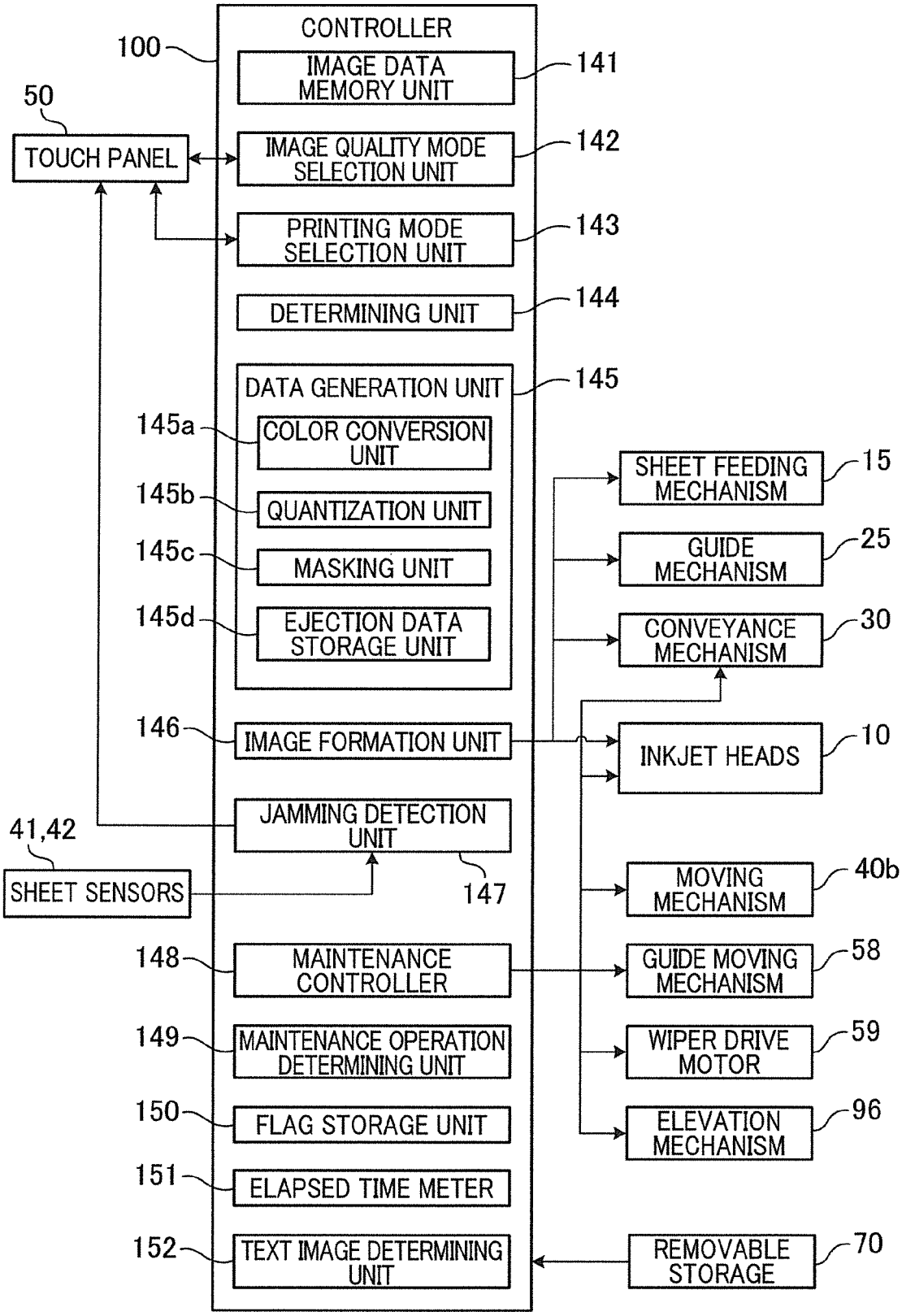
FIG. 8 is a block diagram of an electric configuration of a controller of an inkjet printer of Second Embodiment.
Figure 9:
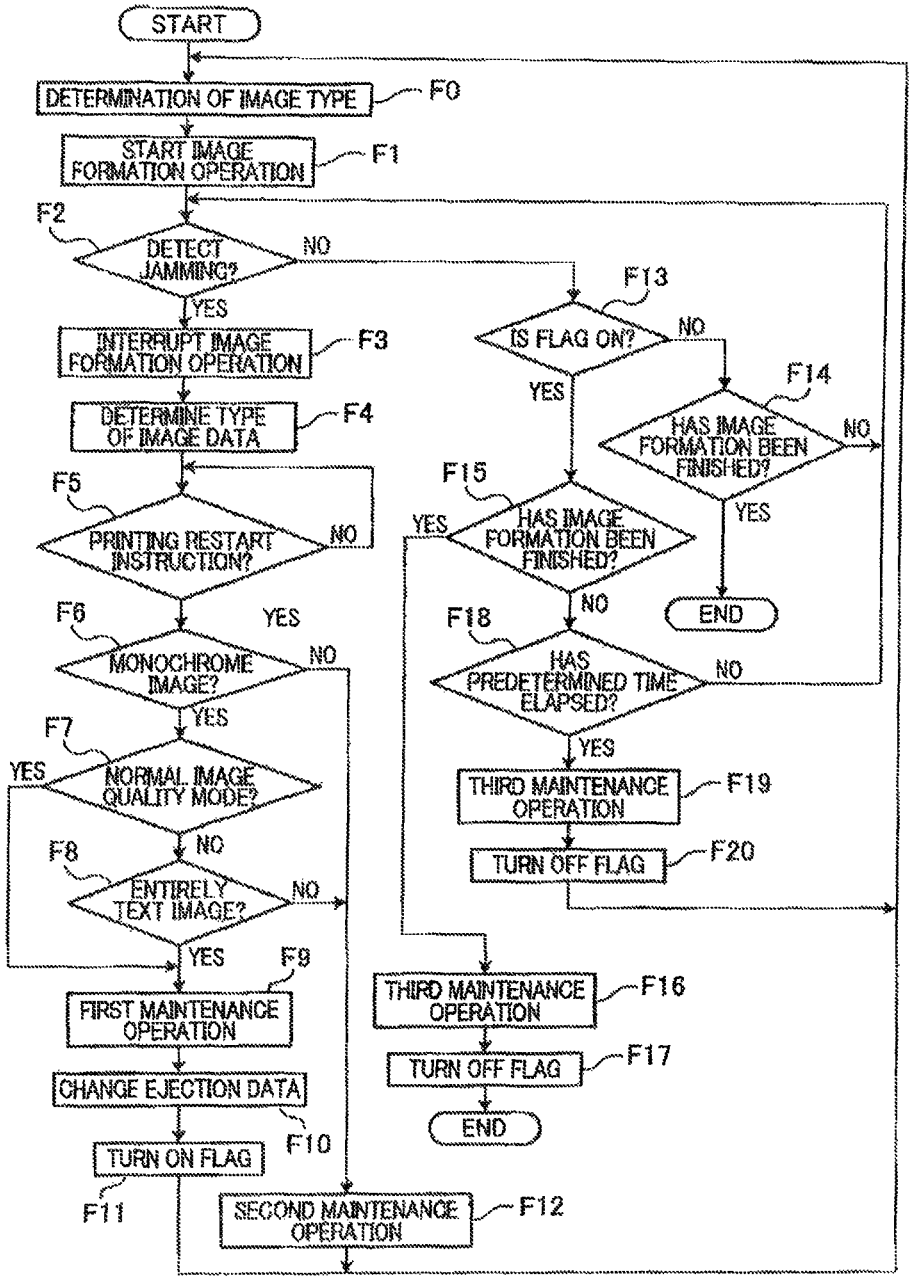
FIG. 9 shows an operation flow of the controller of the inkjet printer of Second Embodiment.
Figure 10:
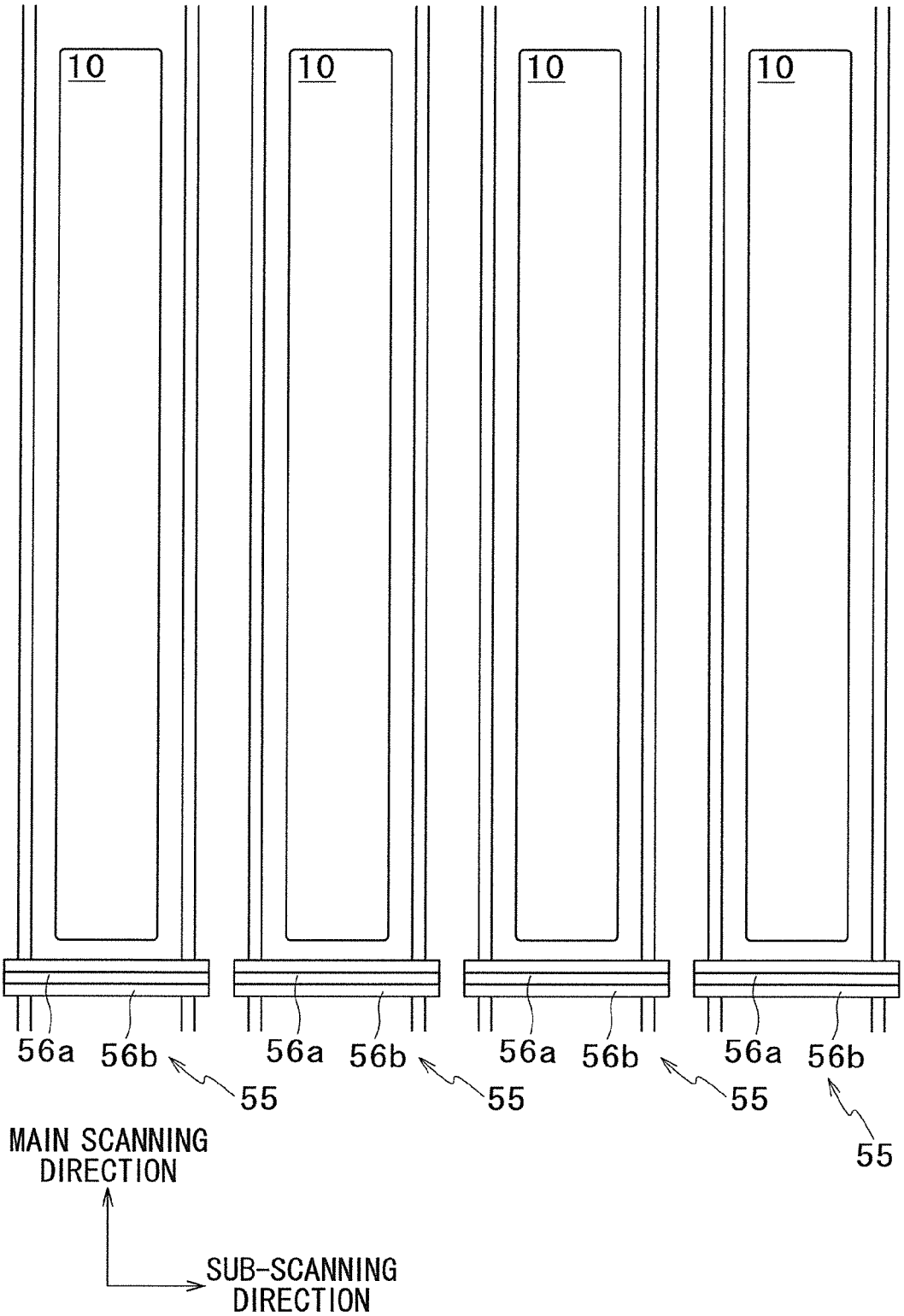
FIG. 10 is a plan view showing four heads of the printer.

Now, Second Embodiment will be described with reference to FIG. 8 and FIG. 9. Second Embodiment is different from First Embodiment in that, as shown in FIG. 8, the controller 100 includes a text image determining unit 152 that determines whether an image formed on a sheet P is entirely a text image. Furthermore, in Second Embodiment, the determining unit 144 determines whether the image to be formed on the sheet P is a monochrome image or a color image based on the image data stored in the image data storage unit 141, not only before the start of the image formation but also when the jamming detection unit 147 detects jamming. Furthermore, the ejection data storage unit 145*d* stores, in addition to the ejection data, sets of quantized image data which have been processed in the quantization unit 145*b* and correspond to black, cyan, magenta, and yellow, respectively. In the present embodiment, members identical with those in First Embodiment above will be denoted by the same reference numerals and the descriptions thereof will be suitably omitted.

When an image to be formed on a sheet P is entirely a text image, the deterioration in the image quality is unlikely to occur even if the text image is formed solely by black ink (single-color dots). For this reason, in the present embodiment, even if the image quality mode selection unit 142 has selected the high image quality mode, the first maintenance operation is conducted without the second maintenance operation in order to start the image formation early after resolving the jamming, when the text image determining unit 152 has determined at the time of the detection of the jamming by the jamming detection unit 147 that the image to be formed on the sheet P is entirely a text image.

Based on the image data stored in the image data memory unit 141, the text image determining unit 152 determines whether the monochrome image to be formed on the sheet P after resolving the jamming is entirely a text image. In this regard, in monochrome images, the rate of black pixels in the total number of pixels is small in text images as compared to picture images. In this regard, based on the image data stored in the image data memory unit 141, the text image determining unit 152 determines that the monochrome image formed on the sheet P is a text image when the rate of the black pixels in the total number of pixels of the monochrome image is smaller than a predetermined value, or determines that the monochrome image is a picture image when the rate of the black pixels is equal to or larger than the predetermined value. As such, the present embodiment makes it possible to easily determine whether a monochrome image is a text image.

In addition to the above, even when the image data stored in the image data memory unit 141 is color image data, in some cases an image formed on the sheet P becomes fully monochrome from the middle of the image formation. In this regard, in the present embodiment, the determining unit 144 determines that the image to be formed on the sheet P is a monochrome image when the jamming detection unit 147 detects jamming and the entirety of the image to be formed on the sheet P after the removal of the jamming is a monochrome image, even if, before the start of the image formation, it has been determined that the image to be formed on the sheet P is a color image.

Now, the operation of the printer 1 of the present embodiment will be described. As shown in FIG. 7, to begin with, the steps F1 to F3 similar to the steps S1 to S3 of the embodiment above are executed. After the step F3, the determining unit 144 determines whether an image to be formed on the sheet P is a monochrome image or a color image based on the image data stored in the image data memory unit 141 (i.e., based on the quantized image data stored in the ejection data storage unit 145*d*), by determining whether the entirety of the image to be formed on the sheet P after resolving the jamming is a monochrome image (F4). Thereafter, the controller 100 waits for a printing restart instruction from the user, after the jammed sheet P is removed (F5). Receiving the printing restart instruction (F5: YES), the maintenance operation determining unit 149 determines whether the image to be formed on the sheet P determined by the determining unit 144 in the step F4 is a monochrome image (F6). When it is determined that the image is not a monochrome image (F6: NO), the maintenance operation determining unit 149 determines that the second maintenance operation is to be executed, and the process proceeds to the step F12.

On the other hand, when it is determined that the image is a monochrome image (F6: YES), the maintenance operation determining unit 149 determines whether the image quality mode selected by the image quality mode selection unit 142 is the normal image quality mode (F7). When the mode is not the normal image quality mode (F7: NO), the text image determining unit 152 determines whether the monochrome image to be formed on the sheet P after resolving the jamming is entirely a text image, based on the image data stored in the image data memory unit 141 (i.e., based on the quantized image data stored in the ejection data storage unit 145*d*) (F8). When the image is not entirely a text image (F8: NO), the maintenance operation determining unit 149 determines that the second maintenance operation is to be executed, and the process proceeds to the step F12.

When it is determined in the step F7 that the mode is the normal image quality mode (F7: YES) or when it is determined in the step F8 that the image is entirely a text image (F8: YES), the maintenance operation determining unit 149 determines that the first maintenance operation is to be executed, and the process goes back to the step F9. In the step F9, the first maintenance operation is executed in a similar manner as in the step S7 in the First Embodiment above. In this regard, being different from First Embodiment, the generation of new black ejection data by the data generation unit 145 is not carried out. After the step F9, the maintenance controller 148 changes the stored content such that the synthesized ejection data stored in the ejection data storage unit 145*d* (i.e., quantized image data for black) is selected as black ejection data (F10). As such, because the synthesized ejection data stored in the ejection data storage unit 145*d* is changed to black ejection data, the processing load on the controller 100 is reduced as compared to cases where black processing data is generated from the image data as in First Embodiment above. After the step F10, the process goes back to the step F11. The steps F11 to F20 are not described here because they are substantially identical with the steps S9 to S18 in First Embodiment above. The printer 1 operates as described above.

As described above, in the printer 1 of the present embodiment, even when an image formed on a sheet P is a monochrome image and the high image quality mode is selected as the image quality mode, the image formation restarts without performing the recovery action of the nozzles 108 of the three heads 12 after resolving the jamming of the sheet P, when the image to be formed on the sheet P is a text image. As such, the image formation starts early after resolving the jamming.

While in the embodiment above the ink in the nozzles 108 of the heads 10 is ejected in the maintenance operation by flushing, the ink may be ejected by purging. Furthermore, while in the embodiment above the recovery action of the nozzles 108 of the heads 10 is carried out by flushing and wiping, any other methods may be used for recovering the nozzles 108.

While in the embodiment above the data generation unit 145 generates monochrome dot image data and combined color image data from synthesized ejection data, these sets of data may be generated without using a mask pattern. For example, when the printer 1 is a printer capable of forming images with more than two gradation levels, the monochrome dot image data and the combined color image data may be generated in accordance with the gradation value of the quantized image data. Furthermore, the mask pattern may not be a checkered mask pattern, and may be selected from various types of mask patterns.

In addition to the above, while in the embodiment above composite black is formed by ejecting yellow, cyan, and magenta inks to the same pixel, composite black may be formed by ejecting yellow, cyan, and magenta inks to a plurality of pixels in a dispersed manner. In this case, the data generation unit 145 generates the color ejection data of each head 12 by arranging the dots of the ink ejected from each head 12 not to overlap one another, based on the combined color dot image data.

While in the embodiment above only one wiper unit 55 is provided for the four heads 10, four wiper units 55 may be provided for the four heads 10, respectively, as shown in FIG.

Figure 11:
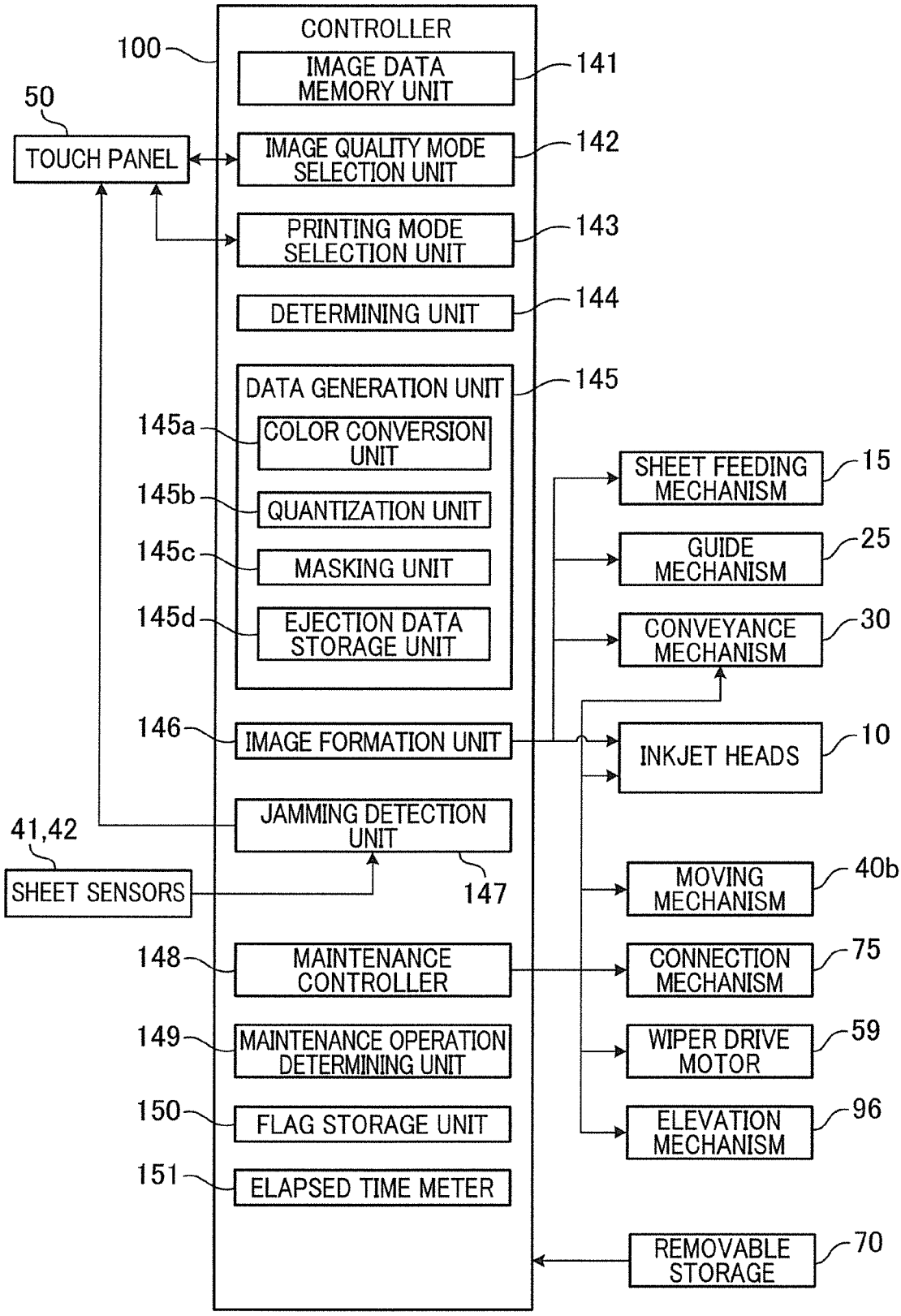
FIG. 11 is a block diagram of an electric configuration of a controller of an inkjet printer.

10. In such a case, each wiper unit 55 includes a wiper 56*a*, a base portion 56*b* supporting the wiper 56*a*, and two guides 57 lined up in the sub-scanning direction. Furthermore, a single wiper drive motor 59 is provided outside the wiper unit 55. This wiper drive motor 59 is connected to a connection mechanism 75 as shown in FIG. 11. The connection mechanism 75 selectively connects the wiper drive motor 59 with one of the four wiper units 55. The maintenance controller 148 controls the wiper drive motor 59 while the wiper drive motor 59 is connected with one of the wiper unit 55 so as to move the wiper 56*a* relative to the ejection surface 10*a* of the head 11. An example of the connection mechanism 75 is a known power switch mechanism utilizing a planetary gear or the like. Also in this arrangement, the four wiper units 55 are allowed to perform the wiping only once for one ejection surface 10.

In addition to the above, while in the embodiment above the three heads 12 eject ink droplets with different colors, 2, 3, 5 or more heads 12 may eject ink droplets with different colors, or a single head 12 may eject ink droplets with different colors.

Furthermore, as long as the processing time of the first maintenance operation is shorter than the processing time of the second maintenance operation, a plurality of wiper units 55 may be provided to simultaneously wipe the ejection surfaces 10*a* of the heads 10.

The present invention is applicable to liquid ejection apparatuses ejecting liquid different from ink. Furthermore, the present invention is applicable not only to printers but also to facsimile machines, photocopiers, or the like.

In the above-described embodiments, the controller 100 may be constituted by a single CPU. Alternatively, the controller 100 may be constituted by a plurality of CPUs, an application-specific integrated circuit (ASIC), or a combination of the CPU(s) and the ASIC.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a conveyance mechanism configured to convey a recording medium;

a first liquid ejection head which includes first nozzles and is configured to eject black liquid through the first nozzles;

at least one second liquid ejection head which includes second nozzles and is configured to eject color liquid which is not black through the second nozzles;

a sensor configured to detect whether the recording medium conveyed by the conveyance mechanism opposes the first nozzles of the first liquid ejection head of the conveyance mechanism;

a maintenance mechanism configured to perform recovery action for the first nozzles of the first liquid ejection head and the second nozzles of the at least one second liquid ejection head, a storage unit configured to store image data of an image formed on the recording medium; and a control device configured to:

control the first liquid ejection head, the at least one second liquid ejection head, and the conveyance mechanism so that the image of the image data is formed on the recording medium;

based on a detection result of the sensor, determine whether jamming of the recording medium has occurred at a position opposing the first nozzles of the first liquid ejection head of the conveyance mechanism;

when it is determined that the jamming has occurred while the image of the image data is being formed on the recording medium, control the first liquid ejection head, the at least one second liquid ejection head, and the conveyance mechanism so that the formation of the image of the image data on the recording medium is interrupted until the jamming of the recording medium is resolved;

when it is determined based on the image data stored in the storage unit that the image formed on the recording medium is a color image, control the maintenance mechanism so that the recovery action for the first nozzles of the first liquid ejection head and the second nozzles of the at least one second liquid ejection head is performed after the jamming of the recording medium is resolved, and then control the first liquid ejection head, the at least one second liquid ejection head, and the conveyance mechanism so that the formation of the color image on the recording medium based on the image data, which has been interrupted on account of the jamming of the recording medium, is resumed;

when it is determined based on the image data stored in the storage unit that the image formed on the recording medium is a monochrome image, control the maintenance mechanism so that the recovery action for the first nozzles of the first liquid ejection head is performed after the jamming of the recording medium is resolved, and then control the first liquid ejection head and the conveyance mechanism so that the formation of the monochrome image on the recording medium based on the image data, which has been interrupted on account of the jamming of the recording medium, is resumed; and when it has been determined that the image formed on the recording medium based on the image data is a color image before it is determined that the jamming of the recording medium has occurred in the conveyance mechanism and the entirety of the image formed on the recording medium after the jamming of the recording medium is resolved is the monochrome image, determine that the image formed on the recording medium based on the image data is the monochrome image when the occurrence of the jamming is detected while the image is being formed on the recording medium based on the image data.

2. The liquid ejection apparatus according to claim 1, wherein, the number of the at least one second liquid ejection head is three or more, and colors of the color liquid ejected from the second nozzles of three of the three or more second liquid ejection heads are yellow, magenta, and cyan, respectively, and the control device is configured to:

when it has been determined based on the image data that the image formed on the recording medium is the monochrome image before it is determined that the jamming of the recording medium has occurred in the conveyance mechanism, control the first liquid ejection head, the three or more second liquid ejection heads, and the conveyance mechanism so that black pixels of the monochrome image are formed on the recording medium by using both single-color dots formed solely by the black liquid ejected from the first nozzles of the first liquid ejection head and combined color dots formed by composite black constituted by the color liquid ejected from each of the second nozzles of the three or more second liquid ejection heads.

3. The liquid ejection apparatus according to claim 1, wherein the control device is configured to:

when the black pixels of the monochrome image are formed on the recording medium by using both the single-color dots and the combined color dots, control the first liquid ejection head, the three or more second liquid ejection heads, and the conveyance mechanism so that, in each pair of black pixels that neighbor each other in the monochrome image, when one of the paired black pixels is formed by using the single-color dots, the other one of the paired black pixels is formed by using the combined color dots.

4. The liquid ejection apparatus according to claim 1, wherein the control device is configured to:

after it is determined that the jamming of the recording medium has occurred in the conveyance mechanism, when the formation of the monochrome image on the recording medium based on the image data, which has been interrupted on account of the jamming of the recording medium, is resumed without performing the recovery action for the second nozzles of the at least one second liquid ejection head, either when the formation of the image on the recording medium based on the image data stored in the storage unit is completed or when a predetermined time elapses after it is determined that the jamming of the recording medium has occurred in the conveyance mechanism, control the maintenance mechanism so that the recovery action is performed for the second nozzles of the at least one second liquid ejection head.

5. The liquid ejection apparatus according to claim 1, wherein the maintenance mechanism is configured to perform the recovery action only once at a time for one of the liquid ejection heads including the first liquid ejection head and the at least one second liquid ejection head.

6. The liquid ejection apparatus according to claim 1, wherein the maintenance mechanism further comprises:

a plurality of nozzle cleaning units corresponding to the first liquid ejection head and each of the at least one second liquid ejection head and configured to clean the first nozzles of the first liquid ejection head and the second nozzles of the at least one second liquid ejection head;

a drive mechanism configured to drive one of the nozzle cleaning units; and a connection mechanism configured to connect the drive mechanism with one of the nozzle cleaning units, wherein the control device is configured to, when it is determined based on the image data stored in the storage unit that the image formed on the recording medium is the monochrome image, control the connection mechanism so that one of the nozzle cleaning units corresponding to the first liquid ejection head is connected with the drive mechanism, after the jamming of the recording medium is resolved, and then control the drive mechanism so that the first nozzles of the first liquid ejection head are cleaned by the one of the nozzle cleaning units corresponding to the first liquid ejection head.

7. The liquid ejection apparatus according to claim 1, wherein the maintenance mechanism is configured to perform the recovery action for the liquid ejection heads one by one when the recovery action is required for more than one of the liquid ejection heads.

8. A liquid ejection apparatus comprising:

a conveyance mechanism configured to convey a recording medium;

a first liquid ejection head which includes first nozzles and is configured to eject black liquid through the first nozzles;

at least one second liquid ejection head which includes second nozzles and is configured to eject color liquid which is not black through the second nozzles;

a sensor configured to detect whether the recording medium conveyed by the conveyance mechanism opposes the first nozzles of the first liquid ejection head of the conveyance mechanism;

a maintenance mechanism configured to perform recovery action for the first nozzles of the first liquid ejection head and the second nozzles of the at least one second liquid ejection head, a storage unit configured to store image data of an image formed on the recording medium; and a control device configured to:

control the first liquid ejection head, the at least one second liquid ejection head, and the conveyance mechanism so that the image of the image data is formed on the recording medium;

based on a detection result of the sensor, determine whether jamming of the recording medium has occurred at a position opposing the first nozzles of the first liquid ejection head of the conveyance mechanism;

when it is determined that the jamming has occurred while the image of the image data is being formed on the recording medium, control the first liquid ejection head, the at least one second liquid ejection head, and the conveyance mechanism so that the formation of the image of the image data on the recording medium is interrupted until the jamming of the recording medium is resolved;

when it is determined based on the image data stored in the storage unit that the image formed on the recording medium is a color image, control the maintenance mechanism so that the recovery action for the first nozzles of the first liquid ejection head and the second nozzles of the at least one second liquid ejection head is performed after the jamming of the recording medium is resolved, and then control the first liquid ejection head, the at least one second liquid ejection head, and the conveyance mechanism so that the formation of the color image on the recording medium based on the image data, which has been interrupted on account of the jamming of the recording medium, is resumed; and when it is determined based on the image data stored in the storage unit that the image formed on the recording medium is a monochrome image, control the maintenance mechanism so that the recovery action for the first nozzles of the first liquid ejection head is performed after the jamming of the recording medium is resolved, and then control the first liquid ejection head and the conveyance mechanism so that the formation of the monochrome image on the recording medium based on the image data, which has been interrupted on account of the jamming of the recording medium, is resumed;

the control device is further configured to:

select, as an image quality mode of the image formed on the recording medium, a normal image quality mode or a high image quality mode with which the image quality is higher than in the normal image quality mode; and when it is determined that the jamming of the recording medium has occurred in the conveyance mechanism while the image is being formed on the recording medium based on the image data, the image data that the image formed on the recording medium is the monochrome image, and the high image quality mode has been selected as the image quality mode, control the maintenance mechanism so that, after resolving the jamming of the recording medium, the recovery action is performed not only for the first nozzles of the first liquid ejection head but also the second nozzles of the three or more second liquid ejection heads, and then, when the formation of the monochrome image on the recording medium based on the image data, which has been interrupted on account of the jamming of the recording medium, is resumed, control the first liquid ejection head, the three or more second liquid ejection heads, and the conveyance mechanism so that the black pixels of the monochrome image are formed by using both the single-color dots and the combined color dots.

9. The liquid ejection apparatus according to claim 8, wherein, the control device is configured to:

when it is determined that the jamming of the recording medium has occurred in the conveyance mechanism while the image indicated is being formed on the recording medium based on the image data, determine whether in the image data stored in the storage unit the image formed on the recording medium after resolving the jamming of the recording medium is entirely a text image; and in response to determining that the jamming of the recording medium has occurred in the conveyance mechanism while the image indicated is being formed on the recording medium based on the image data, the image formed on the recording medium is the monochrome image based on the image data, and the high image quality mode is selected as the image quality mode:

when it is determined that the image formed on the recording medium after resolving the jamming of the recording medium is not entirely the text image, control the maintenance mechanism so that, after resolving the jamming of the recording medium, the recovery action is performed not only for the first nozzles of the first liquid ejection head but also the second nozzles of the three or more second liquid ejection heads, and then, when the formation of the monochrome image on the recording medium based on the image data, which has been interrupted on account of the jamming of the recording medium, is resumed, control the first liquid ejection head, the three or more second liquid ejection heads, and the conveyance mechanism so that the black pixels of the monochrome image are formed by using both the single-color dots and the combined color dots; and when it is determined that the image formed on the recording medium after resolving the jamming of the recording medium is entirely the text image, control the maintenance mechanism so that the recovery action is performed for the first nozzles of the first liquid ejection head after resolving the jamming of the recording medium, and then, when the formation of the monochrome image on the recording medium based on the image data, which has been interrupted on account of the jamming of the recording medium, is resumed, control the first liquid ejection head and the conveyance mechanism so that the black pixels of the monochrome image are formed only by the single-color dots.

10. The liquid ejection apparatus according to claim 9, wherein the control device is configured to:

determine that the image formed on the recording medium based on the image data is the text image when the rate of the black pixels in the total number of pixels in the image is less than a predetermined value, and determine that the image is not the text image when the rate of the black pixels in the total number of pixels in the image is greater than or equal to the predetermined value.

11. A liquid ejection apparatus comprising:

a conveyance mechanism configured to convey a recording medium;

a first liquid ejection head which includes first nozzles and is configured to eject black liquid through the first nozzles;

at least one second liquid ejection head which includes second nozzles and is configured to eject color liquid which is not black through the second nozzles;

a sensor configured to detect whether the recording medium conveyed by the conveyance mechanism opposes the first nozzles of the first liquid ejection head of the conveyance mechanism;

a maintenance mechanism configured to perform recovery action for the first nozzles of the first liquid ejection head and the second nozzles of the at least one second liquid ejection head, a storage unit configured to store image data of an image formed on the recording medium; and a control device configured to:

control the first liquid ejection head, the at least one second liquid ejection head, and the conveyance mechanism so that the image of the image data is formed on the recording medium;

based on a detection result of the sensor, determine whether jamming of the recording medium has occurred at a position opposing the first nozzles of the first liquid ejection head of the conveyance mechanism;

when it is determined that the jamming has occurred while the image of the image data is being formed on the recording medium, control the first liquid ejection head, the at least one second liquid ejection head, and the conveyance mechanism so that the formation of the image of the image data on the recording medium is interrupted until the jamming of the recording medium is resolved;

when it is determined based on the image data stored in the storage unit that the image formed on the recording medium is a color image, control the maintenance mechanism so that the recovery action for the first nozzles of the first liquid ejection head and the second nozzles of the at least one second liquid ejection head is performed after the jamming of the recording medium is resolved, and then control the first liquid ejection head, the at least one second liquid ejection head, and the conveyance mechanism so that the formation of the color image on the recording medium based on the image data, which has been interrupted on account of the jamming of the recording medium, is resumed; and when it is determined based on the image data stored in the storage unit that the image formed on the recording medium is a monochrome image, control the maintenance mechanism so that the recovery action for the first nozzles of the first liquid ejection head is performed after the jamming of the recording medium is resolved, and then control the first liquid ejection head and the conveyance mechanism so that the formation of the monochrome image on the recording medium based on the image data, which has been interrupted on account of the jamming of the recording medium, is resumed;

the control device is further configured to:

from the image data stored in the storage unit, generate black ejection data regarding the single-color dots and color ejection data regarding the combined color dots;

control the first liquid ejection head so that the black liquid is ejected from the first nozzles based on the black ejection data and control the three or more second liquid ejection heads so that the color liquid is ejected from the second nozzles based on the color ejection data; and after it is determined that the jamming of the recording medium has occurred in the conveyance mechanism while the image is being formed on the recording medium based on the image data, when the formation of the monochrome image on the recording medium based on the image data, which has been interrupted on account of the jamming of the recording medium, is resumed without performing the recovery action for the second nozzles of the three or more second liquid ejection heads, newly generate the black ejection data from the image data stored in the storage unit so that the black pixels of the monochrome image based on the image data are formed solely by the single-color dots while the maintenance mechanism is performing the recovery action for the first nozzles, and control the first liquid ejection head and the conveyance mechanism based on the newly-generated black ejection data after the recovery action for the first nozzles.

12. A liquid ejection apparatus comprising:

a conveyance mechanism configured to convey a recording medium;

a first liquid ejection head which includes first nozzles and is configured to eject black liquid through the first nozzles;

at least one second liquid ejection head which includes second nozzles and is configured to eject color liquid which is not black through the second nozzles;

a sensor configured to detect whether the recording medium conveyed by the conveyance mechanism opposes the first nozzles of the first liquid ejection head of the conveyance mechanism;

a maintenance mechanism configured to perform recovery action for the first nozzles of the first liquid ejection head and the second nozzles of the at least one second liquid ejection head, a storage unit configured to store image data of an image formed on the recording medium; and a control device configured to:

control the first liquid ejection head, the at least one second liquid ejection head, and the conveyance mechanism so that the image of the image data is formed on the recording medium;

based on a detection result of the sensor, determine whether jamming of the recording medium has occurred at a position opposing the first nozzles of the first liquid ejection head of the conveyance mechanism;

when it is determined that the jamming has occurred while the image of the image data is being formed on the recording medium, control the first liquid ejection head, the at least one second liquid ejection head, and the conveyance mechanism so that the formation of the image of the image data on the recording medium is interrupted until the jamming of the recording medium is resolved;

when it is determined based on the image data stored in the storage unit that the image formed on the recording medium is a color image, control the maintenance mechanism so that the recovery action for the first nozzles of the first liquid ejection head and the second nozzles of the at least one second liquid ejection head is performed after the jamming of the recording medium is resolved, and then control the first liquid ejection head, the at least one second liquid ejection head, and the conveyance mechanism so that the formation of the color image on the recording medium based on the image data, which has been interrupted on account of the jamming of the recording medium, is resumed; and when it is determined based on the image data stored in the storage unit that the image formed on the recording medium is a monochrome image, control the maintenance mechanism so that the recovery action for the first nozzles of the first liquid ejection head is performed after the jamming of the recording medium is resolved, and then control the first liquid ejection head and the conveyance mechanism so that the formation of the monochrome image on the recording medium based on the image data, which has been interrupted on account of the jamming of the recording medium, is resumed;

the control device is further configured to:

generate synthesized ejection data regarding the black pixels of the image formed on the recording medium from the image data stored in the storage unit, set thinned data generated by thinning the synthesized ejection data by using a mask pattern as one of the black ejection data for the single-color dots and color ejection data for the combined color dots,. and set difference data indicating a difference between the synthesized ejection data and the thinned data as the other one of the black ejection data and the color ejection data;

control the first liquid ejection head so that the black liquid is ejected from the first nozzles based on the black ejection data and control the three or more second liquid ejection heads so that the color liquid is ejected from the second nozzles based on the color ejection data; and after it is determined that the jamming of the recording medium has occurred in the conveyance mechanism, when the formation of the monochrome image on the recording medium based on the image data, which has been interrupted on account of the jamming of the recording medium, is resumed without performing the recovery action for the second nozzles of the three or more second liquid ejection heads and the black pixels of the monochrome image are formed only by using the single-color dots, control the first liquid ejection head and the conveyance mechanism according to the synthesized ejection data instead of the black ejection data.

* * * * *